US011141999B2

(12) United States Patent
Yokota

(10) Patent No.: US 11,141,999 B2
(45) Date of Patent: Oct. 12, 2021

(54) LIQUID EJECTING DEVICE AND CONVEYANCE AMOUNT ADJUSTMENT METHOD

(71) Applicant: SEIKO EPSON CORPORATION, Tokyo (JP)

(72) Inventor: So Yokota, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/800,706

(22) Filed: Feb. 25, 2020

(65) Prior Publication Data

US 2020/0276811 A1 Sep. 3, 2020

(30) Foreign Application Priority Data

Feb. 28, 2019 (JP) ..... JP2019-036327

(51) Int. Cl.
*B41J 11/46* (2006.01)

(52) U.S. Cl.
CPC ..... *B41J 11/46* (2013.01)

(58) Field of Classification Search
CPC ..... B41J 11/46
See application file for complete search history.

(56) References Cited

U.S. PATENT DOCUMENTS

2016/0089883 A1 3/2016 Yokota
2016/0089918 A1* 3/2016 Yokota ..... B41J 29/393 347/14
2017/0072680 A1 3/2017 Yokota

FOREIGN PATENT DOCUMENTS

JP 2016-064622 4/2016
JP 2017-052238 3/2017

* cited by examiner

*Primary Examiner* — Justin Seo
(74) *Attorney, Agent, or Firm* — Workman Nydegger

(57) ABSTRACT

While moving an ejecting unit, first patterns and second patterns are formed in a first direction on a medium. Third patterns corresponding to the first patterns are formed while changing a shifted amount by which the third patterns is shifted from the first patterns by a first shift amount in the second direction. Fourth patterns corresponding to the second patterns are formed while changing a shifted amount by which the fourth patterns is shifted from the second patterns by a first shift amount in the second direction. In a rough adjustment pattern, image density of a pair of patterns, which are formed of the first pattern and the corresponding third pattern, changes in the first direction in a first cycle. In a fine adjustment pattern, image density of a pair of patterns, which are formed of the second pattern and the corresponding fourth pattern, changes in a second cycle.

7 Claims, 11 Drawing Sheets

LIQUID EJECTING DEVICE AND CONVEYANCE AMOUNT ADJUSTMENT METHOD

The present application is based on, and claims priority from JP Application Serial Number 2019-036327, filed Feb. 28, 2019, the disclosure of which is hereby incorporated by reference herein in its entirety.

BACKGROUND

1. Technical Field

The present disclosure relates to a liquid ejecting device and a conveyance amount adjustment method.

2. Related Art

Hitherto, a liquid ejecting device such as a recording device that ejects liquid such as an ink onto a medium such as a target recording medium has been used. As such a liquid ejecting device, there is known a liquid ejecting device that ejects liquid onto a medium while reciprocally moving an ejecting unit and relatively moving the medium and the ejecting unit in a direction intersecting a reciprocating direction of the ejecting unit. With such a liquid ejecting device, generally, a relative movement amount of the medium and the ejecting unit, for example, a conveyance amount for one time along with intermittent conveyance of the medium, is adjusted before the liquid is ejected onto the medium. For example, JP-A-2016-64622 discloses a liquid ejecting device and a conveyance amount adjustment method that are capable of adjusting a conveyance amount for one time along with intermittent conveyance of a medium by forming an adjustment pattern.

However, in recent years, improvement of image quality of a recording device has been demanded. Thus, a conveyance amount is required to be adjusted at high accuracy, and it takes a large amount of time when a conveyance amount is adjusted by using only a fine adjustment pattern being a highly accurate adjustment pattern. Here, a conveyance amount adjustment time can be shortened by combining a rough adjustment pattern being an adjustment pattern having rough accuracy together with the fine adjustment pattern. However, simply by performing the fine adjustment pattern after rough adjustment with the rough adjustment pattern, the conveyance amount adjustment time cannot be shortened sufficiently in some cases depending on demanded image quality.

SUMMARY

In order to solve the above-mentioned problem, a liquid ejecting device according to the present disclosure, includes an ejecting unit that includes a nozzle row ejecting liquid and is configured to move reciprocally in a first direction intersecting the nozzle row, a moving unit configured to move a medium and the ejecting unit relatively to each other in a second direction intersecting the first direction, and a control unit configured to perform control to cause the ejecting unit to eject the liquid and cause the ejecting unit to move for forming a plurality of first patterns and a plurality of second patterns on the medium in the first direction, and forming a plurality of third patterns corresponding to the plurality of first patterns while changing a shifted amount by which the plurality of third patterns is shifted from the plurality of first patterns by a first shift amount in the second direction, and moreover forming a plurality of fourth patterns corresponding to the plurality of second patterns while changing a shifted amount by which the plurality of fourth patterns is shifted from the plurality of second patterns by a second shift amount smaller than the first shift amount in the second direction, wherein a rough adjustment pattern, which is formed of the plurality of first patterns and the plurality of third patterns, and a fine adjustment pattern, which is formed of the plurality of second patterns and the plurality of fourth patterns, are positionally associated with each other in the second direction, the rough adjustment pattern is a pattern in which image density of a pair of patterns, which is formed of the plurality of first patterns and the plurality of third patterns corresponding to the plurality of first patterns, changes in the first direction in a first cycle, and the fine adjustment pattern is a pattern in which image density of a pair of patterns, which is formed of the plurality of second patterns and the plurality of fourth patterns corresponding to the plurality of second patterns, changes in the first direction in a second cycle shorter than the first cycle.

DESCRIPTION OF EXEMPLARY EMBODIMENTS

Figure 1:
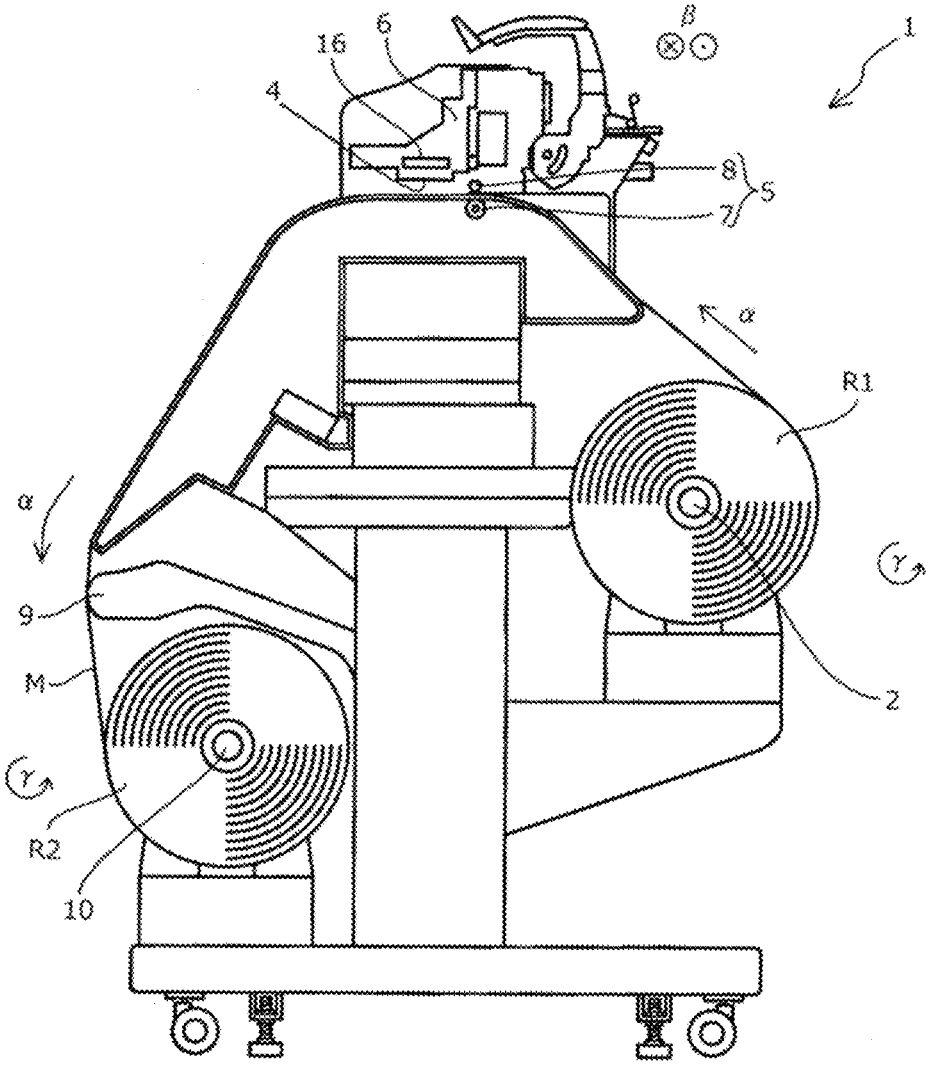
FIG. 1 is a schematic side view illustrating a recording device according to an exemplary embodiment of the present disclosure.

First, the present disclosure will be schematically described.

In order to solve the above-mentioned problem, a liquid ejecting device according to a first mode of the present disclosure, includes, an ejecting unit that includes a nozzle row ejecting liquid and is configured to move reciprocally in a first direction intersecting the nozzle row, a moving unit configured to move a medium and the ejecting unit relatively to each other in a second direction intersecting the first direction, and a control unit configured to perform control to cause the ejecting unit to eject the liquid, and cause the ejecting unit to move for forming a plurality of first patterns and a plurality of second patterns on the medium in the first direction, and forming a plurality of third patterns corresponding to the plurality of first patterns while changing a shifted amount by which the plurality of third patterns is shifted from the plurality of first patterns by a first shift amount in the second direction, and moreover forming a plurality of fourth patterns corresponding to the plurality of second patterns while changing a shifted amount by which the plurality of fourth patterns is shifted from the plurality of second patterns by a second shift amount smaller than the first shift amount, wherein a rough adjustment pattern, which is formed of the plurality of first patterns and the plurality of third patterns, and a fine adjustment pattern, which is formed of the plurality of second patterns and the plurality of fourth patterns, are positionally associated with one each other in the second direction, the rough adjustment pattern is a pattern in which image density of a pair of patterns, which is formed of the plurality of first patterns and the plurality of third patterns corresponding to the plurality of first patterns, changes in the first direction in a first cycle, and the fine adjustment pattern is a pattern in which image density of a pair of patterns, which is formed of the plurality of second patterns and the plurality of fourth patterns corresponding to the plurality of second patterns, changes in the first direction in a second cycle shorter than the first cycle.

According to this mode, a plurality of pattern pairs of the first patterns and the third patterns as the rough adjustment pattern and a plurality of pattern pairs of the second patterns and the four patterns as the fine adjustment pattern are formed in the first direction being the reciprocating direction of the ejecting unit. Thus, the rough adjustment pattern and the fine adjustment pattern can be formed simultaneously, and hence a time period required for adjusting a conveyance amount of the medium can be shortened effectively.

In the liquid ejecting device according to a second mode of the present disclosure, in the first mode, the fine adjustment pattern has the cyclical change for two or more cycles.

According to this mode, the fine adjustment pattern has the cyclical change for two or more cycles. Thus, the adjustment range with the fine adjustment pattern in the second direction, which is associated with the rough adjustment pattern, can be secured widely, and at least one of the adjustment range and the adjustment accuracy of a position of the liquid landing on the medium can be improved.

In the liquid ejecting device according to a third mode of the present disclosure, in the first or second mode, the control unit changes at least one nozzle to be used among a plurality of nozzles included in the nozzle row, and the control unit controls to form the plurality of third patterns corresponding to the plurality of first patterns while changing a shifted amount by which the plurality of third patterns is shifted from the plurality of first patterns by a first shift amount in the second direction, and form the plurality of fourth patterns corresponding to the plurality of second patterns while changing a shifted amount by which the plurality of fourth patterns is shifted from the plurality of second patterns by a second shift amount smaller than the first shift amount.

According to this mode, the rough adjustment pattern and the fine adjustment pattern are formed by changing the used nozzle, and thus there is no need to repeatedly form the adjustment pattern for the conveyance amount a plurality of times while changing the conveyance amount. Thus, the adjustment pattern for the conveyance amount can be formed easily in a short time period.

In the liquid ejecting device according to a fourth mode of the present disclosure, in any one of the first to third modes, the moving unit includes a driving roller configured to move the medium in the second direction.

According to this mode, the medium can be conveyed more easily by the driving roller.

In the liquid ejecting device according to a fifth mode of the present disclosure, in the fourth mode, the control unit performs control to form the rough adjustment pattern and the fine adjustment pattern during a first pattern formation operation, then rotate the driving roller to a position shifted by a distance for a half rotation from a rotation starting position in the first pattern formation operation, and form the rough adjustment pattern and the fine adjustment pattern during a second pattern formation operation.

According to this mode, deviation from the optimum conveyance amount can be suppressed by, for example, averaging the results from the first pattern formation operation and the results from the second pattern formation operation even when the driving roller is eccentric.

In the liquid ejecting device according to a sixth mode of the present disclosure, in the fourth or fifth mode, the control unit performs control to execute formation of the rough adjustment pattern and the fine adjustment pattern and rotation of the driving roller for a plurality of times while changing a rotation amount of the driving roller.

According to this mode, formation of the rough adjustment pattern and the fine adjustment pattern and rotation of the driving roller are executed for a plurality of times while changing a rotation amount of the driving roller, and hence a conveyance amount of the medium can be adjusted particularly at high accuracy.

The liquid ejecting device according to a seventh mode of the present disclosure, in the fifth mode, the rough adjustment pattern and the fine adjustment pattern are associatedly positioned in the second direction to select a selected range of the fine adjustment pattern along with selection of a selected position in the rough adjustment pattern, and the control unit sets an adjustment value based on a reference value in the selected range.

According to this mode, the rough adjustment pattern and the fine adjustment pattern are associatedly positioned in the second direction to select the selected range of the fine adjustment pattern along with selection of the selected position in the rough adjustment pattern, and the adjustment value is set based on the reference value in the selected range. Thus, by selecting the selected position in the rough adjustment pattern, the selected range of the reference value of the fine adjustment pattern can be selected easily.

A conveyance amount adjustment method according to an eighth mode of the present disclosure is executed through use of a liquid ejecting device including an ejecting unit that includes a nozzle row configured to eject liquid and is movable reciprocally in a first direction intersecting the nozzle row and a moving unit configured to move a medium and the ejecting unit relatively with each other in a second direction intersecting the first direction. The conveyance amount adjustment method includes forming a plurality of first patterns and a plurality of second patterns on the medium in the first direction, and forming a plurality of third patterns corresponding to the plurality of first patterns while changing a shifted amount by which the plurality of third patterns is shifted from the plurality of first patterns by a first shift amount in the second direction and forming a plurality of fourth patterns corresponding to the plurality of second patterns while changing a shifted amount by which the plurality of fourth patterns is shifted from the plurality of second patterns by a second shift amount smaller than the first shift amount in the second direction, wherein a rough adjustment pattern, which is formed of the plurality of first patterns and the plurality of third patterns, and a fine adjustment pattern, which is formed of the plurality of second patterns and the plurality of fourth patterns, are positionally associated with each other in the second direction, the rough adjustment pattern is a pattern in which image density of a pair of patterns, which is formed of the plurality of first patterns and the plurality of third patterns corresponding to the plurality of first patterns, changes in the first direction in a first cycle, and the fine adjustment pattern is a pattern in which image density of a pair of patterns, which is formed of the plurality of second patterns and the plurality of fourth patterns corresponding the plurality of second patterns, changes in the first direction in a second cycle shorter than the first cycle.

According to this mode, with the first step and the second step, a plurality of pattern pairs of the first patterns and the third patterns as the rough adjustment pattern and a plurality of pattern pairs of the second patterns and the four patterns as the fine adjustment pattern are formed in the first direction being the reciprocating direction of the ejecting unit. Thus, the rough adjustment pattern and the fine adjustment pattern can be formed simultaneously, and hence a time period required for adjusting a conveyance amount of the medium can be shortened effectively.

A recording device as a liquid ejecting device according to an exemplary embodiment of the present disclosure will be described below, with reference to the appended drawings.

First, an overview of the recording device according to the exemplary embodiment of the present disclosure will be described.

FIG. 1 is a schematic side view of a recording device 1 according to the present exemplary embodiment.

The recording device 1 according to the present exemplary embodiment includes a support shaft 2 that supports a roll R1 of a roll-shaped target recording medium (medium) M for performing recording. Further, in the recording device 1 according to the present exemplary embodiment, when the target recording medium M is conveyed in a conveyance direction α, the support shaft 2 is rotated in a rotation direction γ. Note that, the present exemplary embodiment uses the roll-type target recording medium M wounded to have a target recording surface facing outward. When using the roll-type target recording medium M wound to have the target recording surface facing inward, the support shaft 2 can be rotated in a direction reverse to the rotation direction γ to feed the roll R1.

Further, the recording device 1 according to the present exemplary embodiment uses a roll-type target recording medium as the target recording medium M. However, the present disclosure is not limited to such a recording device using a roll-type target recording medium. For example, a cutform-type target recording medium may be used.

Further, the recording device 1 according to the present exemplary embodiment includes, as a moving unit, a conveyance roller pair 5 formed of a driving roller 7 and driven rollers 8 for conveying the target recording medium M in the conveyance direction α through a conveyance path of the target recording medium M, which is formed of a medium support portion 3 and the like. Note that, in the recording device 1 according to the present exemplary embodiment, the driving roller 7 is formed of one roller extending in a direction β intersecting the conveyance direction α of the target recording medium M. Further, the plurality of driven rollers 8 are provided to be arrayed in the direction β at positions facing the driving roller 7. Further, the recording device 1 according to the present exemplary embodiment is a recording device including, as a moving unit, the conveyance roller pair 5 that conveys the target recording medium M in the conveyance direction α with respect to a recording head 4. The recording device 1 is only required to include a moving unit that relatively moves the target recording medium M and an ejecting unit, and may be a recording device of a so-called flat bed type that moves the ejecting unit with respect to the target recording medium M. Specifically, "conveyance" in the present disclosure indicates to move the ejecting unit with respect to the medium.

Note that, below the medium support portion 3, a heater (not shown) capable of heating the target recording medium M supported on the medium support portion 3 is provided. As described above, the recording device 1 according to the present exemplary embodiment includes the heater capable of heating the target recording medium M from the medium support portion 3 side. Instead, an infrared heater or the like provided at a position facing the medium support portion 3 may be included.

Further, the recording device 1 according to the present exemplary embodiment includes the recording head 4 and a carriage 6. The recording head 4 includes a nozzle formation surface provided with a plurality of nozzles, and functions as an ejecting unit that performs recording by ejecting ink from the nozzles. The carriage 6 is mounted with the recording head 4, and is reciprocally movable in the direction β. With this, the recording head 4 is reciprocally movable in the direction β while ejecting the ink.

Further, the carriage 6 is provided with a sensor 16 that reads density of an image formed with the ink ejected from the recording head 4 onto the target recording medium M. When the carriage 6 is moved in the direction β, reading can be performed over an entire width direction of the target recording medium M, which corresponds to the direction β. Here, for example, the density of the image is indicated with, in a predetermined region on the surface of the target recording medium M, a ratio of an area of a part onto which the ink is applied to an entire area of the predetermined region. The sensor 16 is, for example, an optical sensor, and includes a light-emitting portion that irradiates the surface of the target recording medium M with light and a light-receiving portion that receives reflected light generated by reflecting the irradiation light from the light-emitting portion on the surface of the target recording medium M. When density of an image formed on the target recording medium M is high, a ratio of the area of the part onto which the ink is applied to the entire area of the predetermined region is higher than a case where density of the image is low. Thus, the irradiation light is absorbed in an ink layer more. With this, when the density of the image is high, intensity of the reflected light toward the light-receiving portion is lowered than the case where the density of the image is low, and hence an output value from the sensor 16 is reduced. Here, reflectivity is obtained by dividing the intensity of the reflected light by intensity of the irradiation light. Therefore, when the density of the image is high, the reflectivity is lowered than the case where the density of the image is low.

Note that, when the ink contains magnetic particles such as iron and cobalt, the sensor 16 is not to limited to an optical type, and may be a magnetic type. Alternatively, the sensor 16 may be both an optical type and a magnetic type.

Further, a winding shaft 10 capable of winding the target recording medium M as a roll R2 is provided downstream of the recording head 4 in the conveyance direction α of the target recording medium M. Note that, in the exemplary embodiment, the target recording medium M is wound to have the target recording surface facing outward. When the target recording medium M is wound, the winding shaft 10 is rotated in the rotation direction γ. On the other hand, when winding is performed to have the target recording surface facing inward, winding can be performed in the direction reverse to the rotation direction γ.

Further, a tension bar 9 is provided between the winding shaft 10 and a downstream end of the medium support portion 3 in the conveyance direction α of the target recording medium M. The tension bar 9 has a contact portion that is held in contact with the target recording medium M and extends in the direction β, and is capable of applying predetermined tension to the target recording medium M.

Next, the electrical configuration of the recording device 1 according to the present exemplary embodiment will be described.

Figure 2:
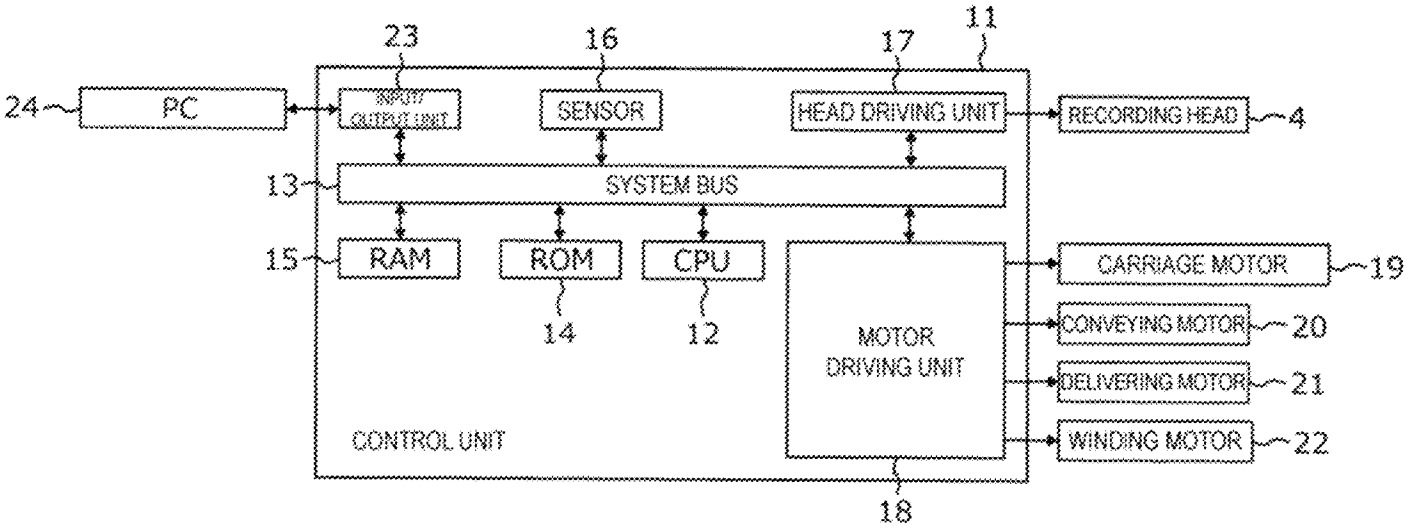
FIG. 2 is a block diagram of the recording device according to the exemplary embodiment of the present disclosure.

FIG. 2 is a block diagram of the recording device 1 according to the present exemplary embodiment.

A control unit 11 includes a CPU 12 that manages control of the entire recording device 1. The CPU 12 is connected through a system bus 13 to a ROM 14 that stores, for example, various control programs to be implemented by the CPU 12, and to a RAM 15 capable of temporarily storing data.

Furthermore, the CPU 12 is connected through the system bus 13 to the sensor 16. In addition, the CPU 12 is connected through the system bus 13 to a head driving unit 17 for driving the recording head 4.

Furthermore, the CPU 12 is connected through the system bus 13 to a motor driving unit 18 that is connected to a carriage motor 19, a conveying motor 20, a feeding motor 21, and a winding motor 22.

Here, the carriage motor 19 is a motor for moving, in the direction β, the carriage 6 mounted with the recording head 4. In addition, the conveying motor 20 is a motor for driving the driving roller 7 that forms the conveyance roller pair 5. Moreover, the feeding motor 21 is a rotating mechanism for the support shaft 2, and is a motor for driving the support shaft 2 to feed the target recording medium M to the conveyance roller pair 5. Yet moreover, the winding motor 22 is a driving motor for rotating the winding shaft 10.

Furthermore, the CPU 12 is connected through the system bus 13 to an input/output unit 23 that is connected to a PC 24 for receiving and transmitting data such as recording data and signals.

With this configuration, the control unit 11 in the present exemplary embodiment is capable of controlling the recording head 4 being an ejecting unit, the driving roller 7 being a conveyance roller and the carriage 6 that form a conveyance unit, and the like. Further, the control unit 11 controls the recording head 4, the driving roller 7, the carriage 6, and the like, and thus recording can be performed by repeatedly performing, in an alternate manner, conveyance of the target recording medium M by a predetermined amount and ejection of the ink while moving the recording head 4 in the direction β.

Next, the recording head 4 in the present exemplary embodiment will be described.

Figure 3:
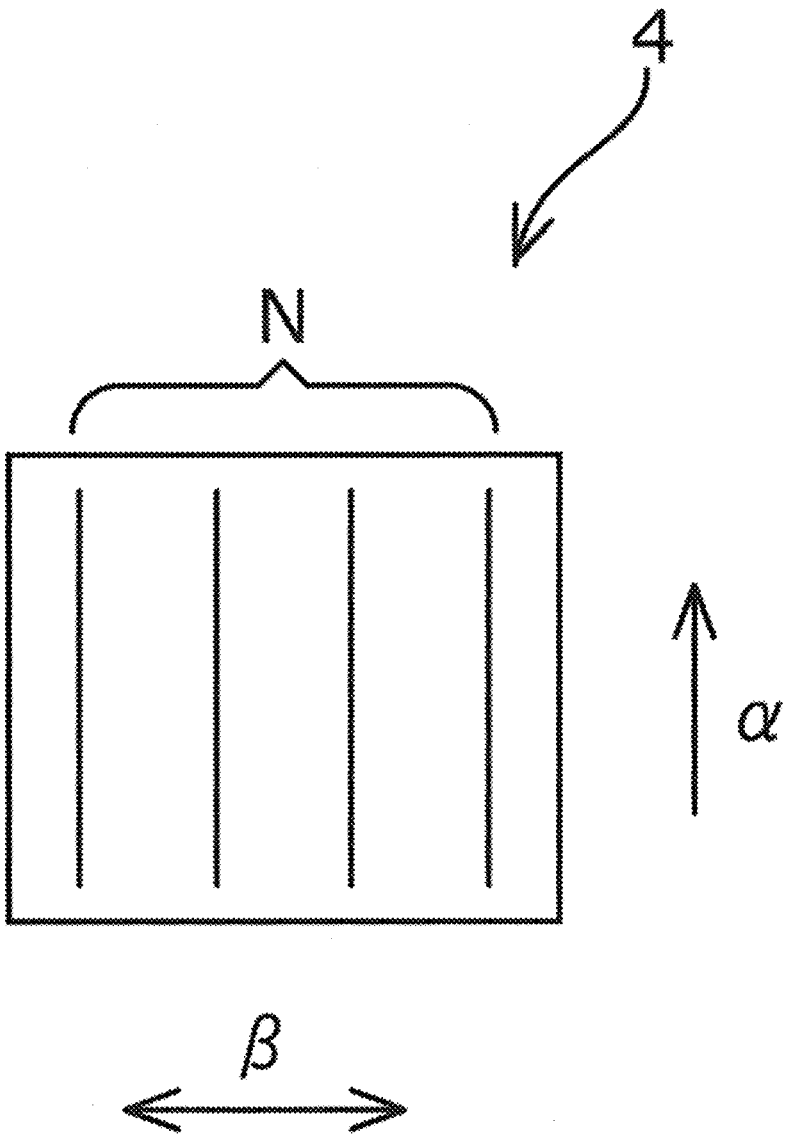
FIG. 3 is a schematic bottom view illustrating a recording head of the recording device according to the exemplary embodiment of the present disclosure.

FIG. 3 is a bottom view of the recording head 4 in the present exemplary embodiment.

As illustrated in FIG. 3, the recording head 4 in the present exemplary embodiment includes nozzles rows N that eject an ink being one example of liquid. The nozzle row N is formed of a plurality of nozzles arrayed along the conveyance direction α. Further, the recording head 4 in the present exemplary embodiment is configured to be reciprocally movable with the carriage 6 in the direction β being a first direction intersecting the nozzle rows N. Note that, a direction along the conveyance direction α intersecting the direction β being the first direction corresponds to a second direction.

Next, an adjustment pattern P for a conveyance amount of the target recording medium M in the recording device 1 according to the present exemplary embodiment will be described, with reference to FIG. 4 to FIG. 10.

Figure 4:
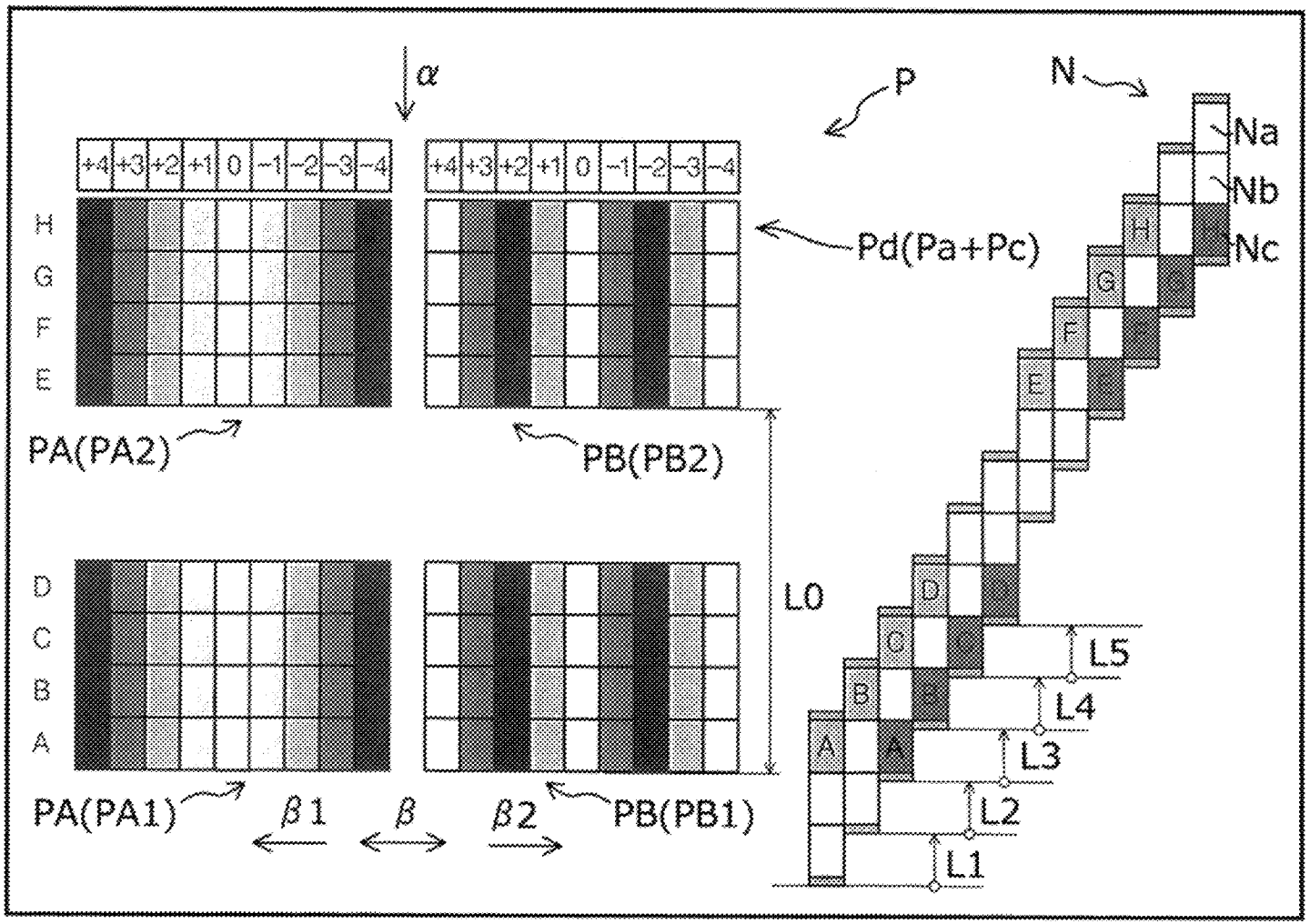
FIG. 4 is a schematic view illustrating adjustment patterns of the recording device according to the exemplary embodiment of the present disclosure, the schematic view in which all the adjustment patterns correspond to positions of nozzles.

As illustrated in FIG. 4, the adjustment pattern P in the present exemplary embodiment includes a rough adjustment pattern PA and a fine adjustment pattern PB having an adjustment resolution higher than the rough adjustment pattern PA. Further, in the rough adjustment pattern PA, first rough adjustment patterns PA1 are formed. After forming the first rough adjustment patterns PA1, the driving roller 7 is rotated to a position deviated by a distance for a half rotation from a rotation starting position at which formation of the first rough adjustment patterns PA1 is started, and conveyance is performed by a conveyance amount L0. Then, second rough adjustment patterns PA2 are formed. Similarly, in the fine adjustment pattern PB, first fine adjustment patterns PB1 are formed. After forming the first fine adjustment patterns PB1, the driving roller 7 is rotated to a position deviated by a distance for a half rotation from a rotation starting position at which formation of the first fine adjustment patterns PB1 is started, and conveyance is performed by the conveyance amount L0. Then, second fine adjustment patterns PB2 are formed. Note that, the first rough adjustment patterns PA1 and the first fine adjustment patterns PB1 are formed with one reciprocating movement operation of the recording head 4, and the second rough adjustment patterns PA2 and the second fine adjustment patterns PB2 are formed with one reciprocating movement operation of the recording head 4. Specifically, the rough adjustment pattern PA and the fine adjustment pattern PB are formed simultaneously.

Figure 5:
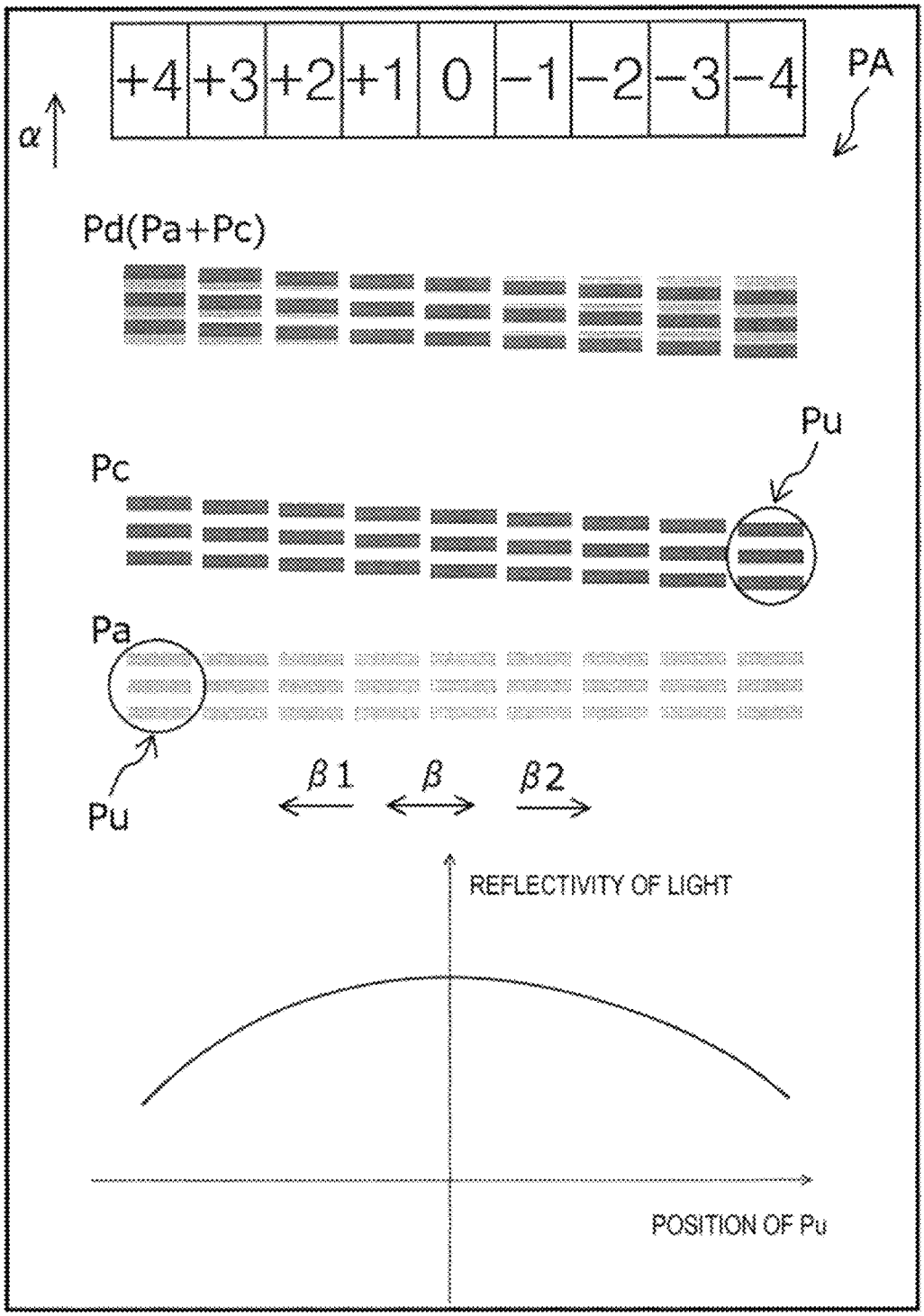
FIG. 5 is a schematic view illustrating rough adjustment patterns of the recording device according to the exemplary embodiment of the present disclosure.
Figure 6:
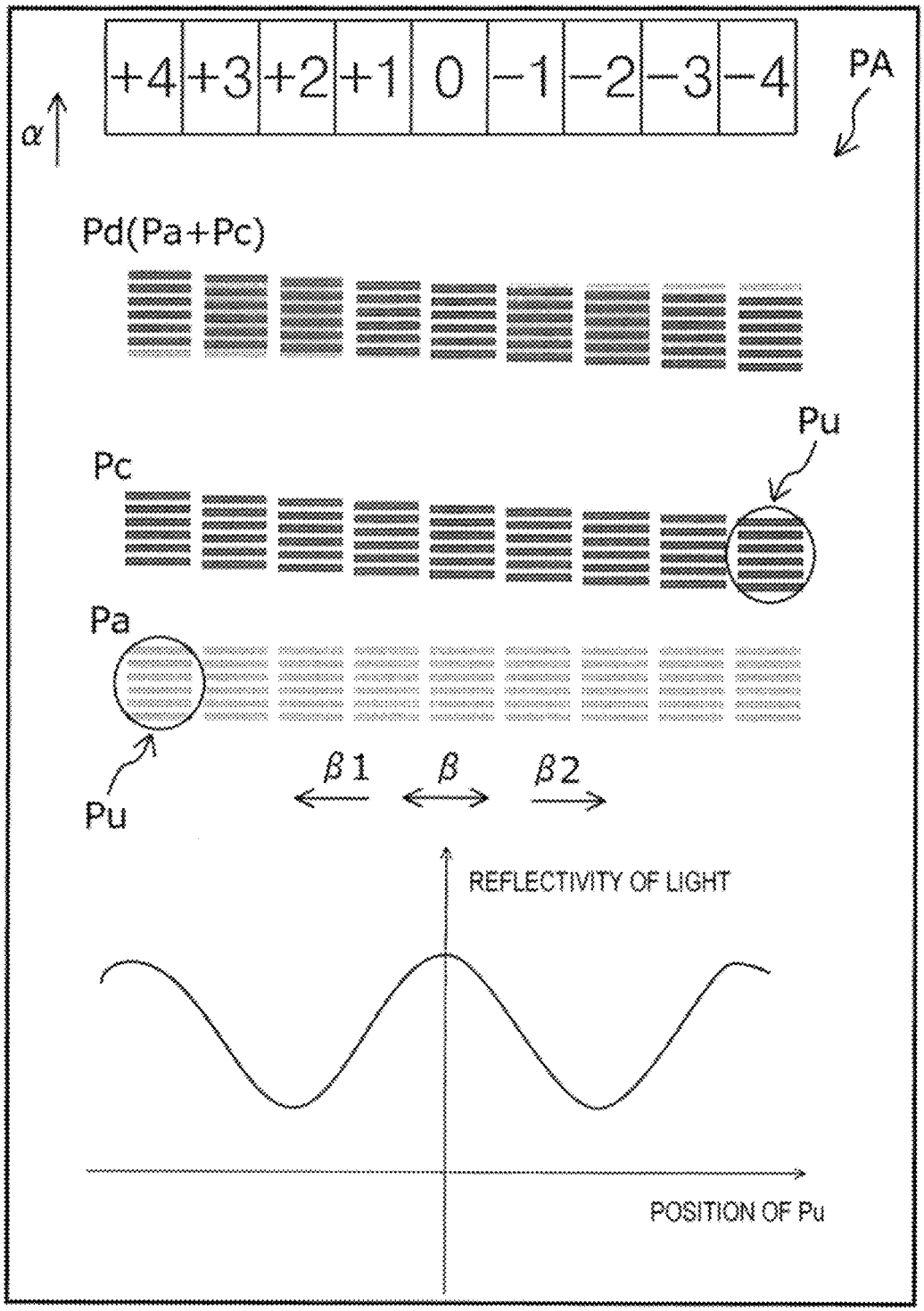
FIG. 6 is a schematic view illustrating fine adjustment patterns of the recording device according to the exemplary embodiment of the present disclosure.

Further, each of the nozzle rows N is divided into three regions, namely, a region Na, a region Nb, and a region Nc. The adjustment pattern P is formed of a reference pattern Pa using the region Na and a shift pattern Pc using the region Nc. Here, as illustrated in FIG. 5 and FIG. 6, the reference pattern Pa and the shift pattern Pc are formed in an overlapping manner. In this manner, an overlapping pattern Pd is formed. FIG. 4 illustrates a state in which eight rows of the overlapping patterns Pd are formed from row A to row H. Note that, from row A to row D, the overlapping patterns Pd of the first rough adjustment patterns PA1 and the first fine adjustment patterns PB1 are formed. From row E to row H, the overlapping patterns Pd of the second rough adjustment patterns PA2 and the second fine adjustment patterns PB2 are formed. Specifically, the adjustment pattern P includes the overlapping patterns Pd of the first rough adjustment patterns PA1 and the first fine adjustment patterns PB1 and the overlapping patterns Pd of the second rough adjustment patterns PA2 and the second fine adjustment patterns PB2.

As illustrated in FIG. 5 and FIG. 6, in each of the rough adjustment pattern PA and the fine adjustment pattern PB, the reference pattern Pa and the shift pattern Pc both include units Pu. In each of the units Pu, a plurality of rectangular patterns having a longitudinal direction in the direction β are arrayed in the conveyance direction α at an equal interval. Further, the units Pu are arrayed in the direction β. Specifically, each of the rough adjustment pattern PA and the fine adjustment pattern PB includes the plurality of units Pu arrayed in the direction β. Each of the plurality of units Pu is formed by arraying the plurality of rectangular patterns having the longitudinal direction in the direction β at an equal interval from each other in the conveyance direction α. Note that, in FIG. 5, nine units Pu each of which is formed of three rectangular patterns arrayed in the conveyance direction α are arrayed in the direction β. Further, in FIG. 6, nine units Pu each of which is formed of six rectangular patterns arrayed in the conveyance direction α are arrayed in the direction β. However, the number of the rectangular patterns is not particularly limited. Here, as illustrated in FIG. 4 to FIG. 6, in the adjustment pattern P, numerals from −4 to +4 are given correspondingly to the nine units Pu arrayed in the direction β. The recording device 1 according to the present exemplary embodiment has a configuration in which a conveyance amount of the medium can be automatically set under control of the control unit 11 by reading image density of the units Pu with the sensor 16, and also has a configuration in which a conveyance amount of the medium can be set by a user with selection of a desired numeral among those numerals through use of the PC 24 or the like.

Further, as illustrated in FIG. 5 and FIG. 6, in the reference pattern Pa, the nine units Pu are arrayed in the direction β without being shifted in the conveyance direction α. Further, in the shift pattern Pc, the nine units Pu each having the rectangular patterns are arrayed in the direction β by being shifted in the conveyance direction α at an equal pitch. The reference pattern Pa and the shift pattern Pc described above overlap with each other to form the overlapping pattern Pd being a pattern in which an overlapping degree of the units Pu in the reference pattern Pa and the units Pu in the shift pattern Pc changes in the direction β. In another expression, in the rough adjustment pattern PA illustrated in FIG. 5, a plurality of shift patterns Pc are formed correspondingly to a plurality of reference patterns Pa while changing a shift amount by a plurality of nozzles being a first shift amount in the conveyance direction α. First, in the fine adjustment pattern PB illustrated in FIG. 6, a plurality of shift patterns Pc are formed correspondingly to a plurality of reference patterns Pa while changing a shift amount by one or a plurality of nozzles being a second shift amount, which is smaller than the first shift amount, in the conveyance direction α.

Figure 7:
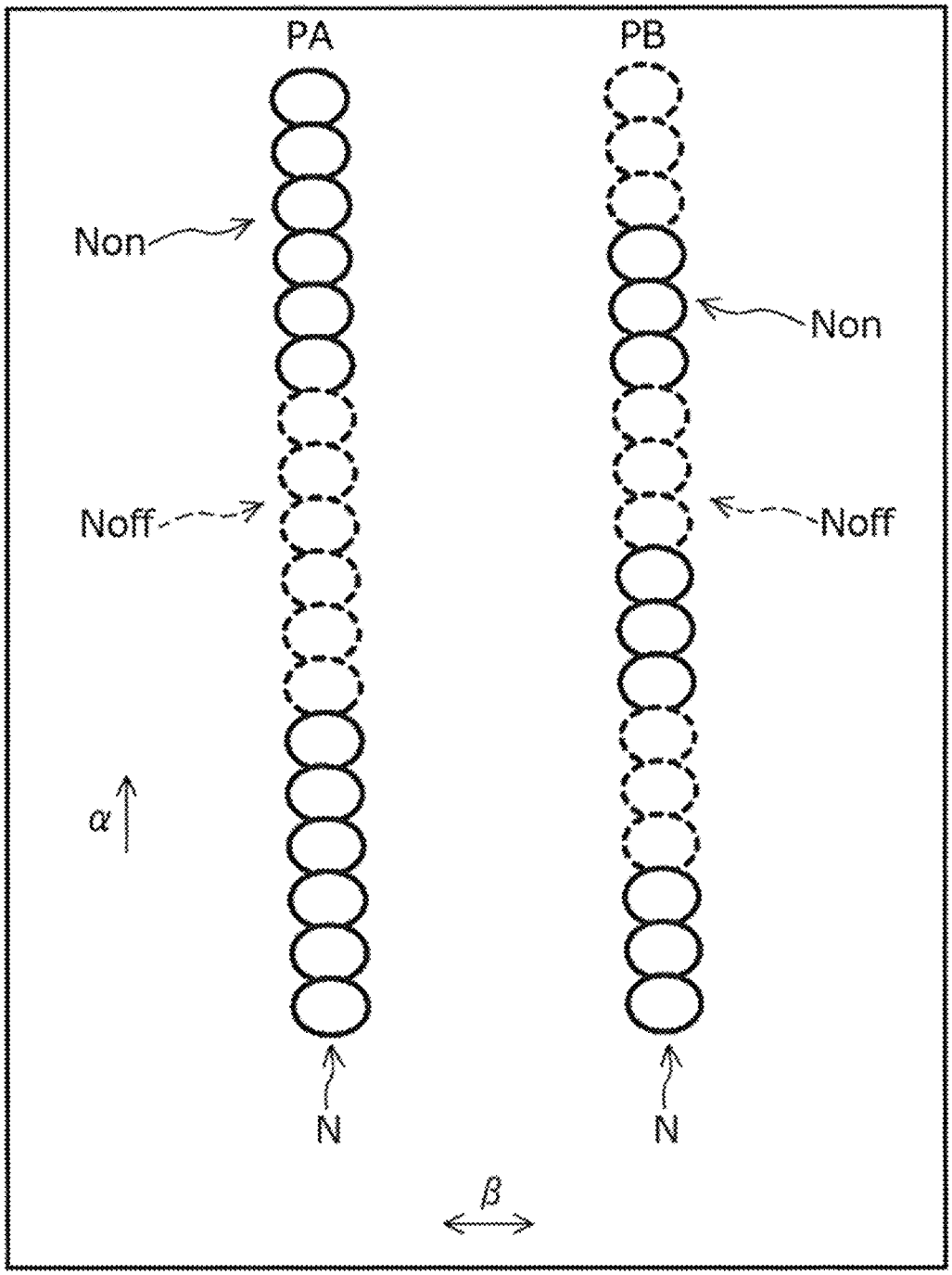
FIG. 7 is a schematic view illustrating used nozzles when forming the adjustment patterns.

As apparent from the comparison between FIG. 5 and FIG. 6, the rough adjustment pattern PA and the fine adjustment pattern PB are different in the length of the rectangular pattern in the conveyance direction α. This is due to a used nozzle at the time of forming the rectangular pattern. As illustrated in FIG. 7, for example, when the rough adjustment pattern PA is formed, driven nozzles Non formed of adjacent six nozzles and non-driven nozzles Noff formed of adjacent six nozzles are alternated in the nozzle row N, and the units Pu having the rectangular patterns are formed. Further, when the fine adjustment pattern PB is formed, driven nozzles Non formed of adjacent three nozzles and non-driven nozzles Noff formed of adjacent three nozzles are alternated in the nozzle row N, and the units Pu having the rectangular patterns are formed. Specifically, when the recording head 4 is moved reciprocally in the direction β, the number and the positions of the driven nozzles Non and the number and the positions of the non-driven nozzles Noff are changed in accordance with a position at which the rough adjustment pattern PA is to be formed and a position at which the fine adjustment pattern PB is to be formed in the direction β. With this, the recording head 4 forms the rough adjustment pattern PA and the fine adjustment pattern PB simultaneously while being moved in the direction β. Note that, when the reference pattern Pa is formed, the number and the positions of the drive nozzles Non and the number and the positions of the non-driven nozzles Noff for forming the units Pu are not changes. In contrast, when the shift pattern Pc is formed, the positions of the drive nozzles Non and the positions of the non-driven nozzles Noff for forming the units Pu having the rectangular patterns are shifted in the direction β by one or a plurality of nozzles every time a subsequent unit Pu is formed. Further, a shift amount of the nozzles in a case of forming the rough adjustment pattern PA is more than that in a case of forming the fine adjustment pattern PB.

As described above, the recording device 1 according to the present exemplary embodiment has a configuration in which the sensor 16 reads density of an image of the units Pu having the rectangular patterns and a conveyance amount of the medium can be automatically set under control of the control unit 11 based on the reading result of the image density. Each of the graphs in FIG. 5 and FIG. 6 is a graph for showing reflectivity of light in inverse proportion to the image density of the nine units Pu having the rectangular patterns, which are arrayed in the direction β. Specifically, the graph is obtained by connecting, with a smooth line, the reflectivity of light of the nine units Pu having the rectangular patterns, and shows the reflectivity of light correspondingly to a conveyance amount of the medium, that is, a rotation amount of the driving roller 7. As described above, as the image density is higher, the reflectivity of light is lowered. Thus, the reflectivity of light is in inverse proportion to the image density. The recording device 1 according to the present exemplary embodiment sets a conveyance amount so that the set conveyance amount corresponds to the unit Pu having the rectangular patterns with the highest reflectivity of light, that is, with the lowest image density. The conveyance amount referred herein corresponds to a conveyance amount for one time along with intermittent conveyance of the medium.

Figure 8:
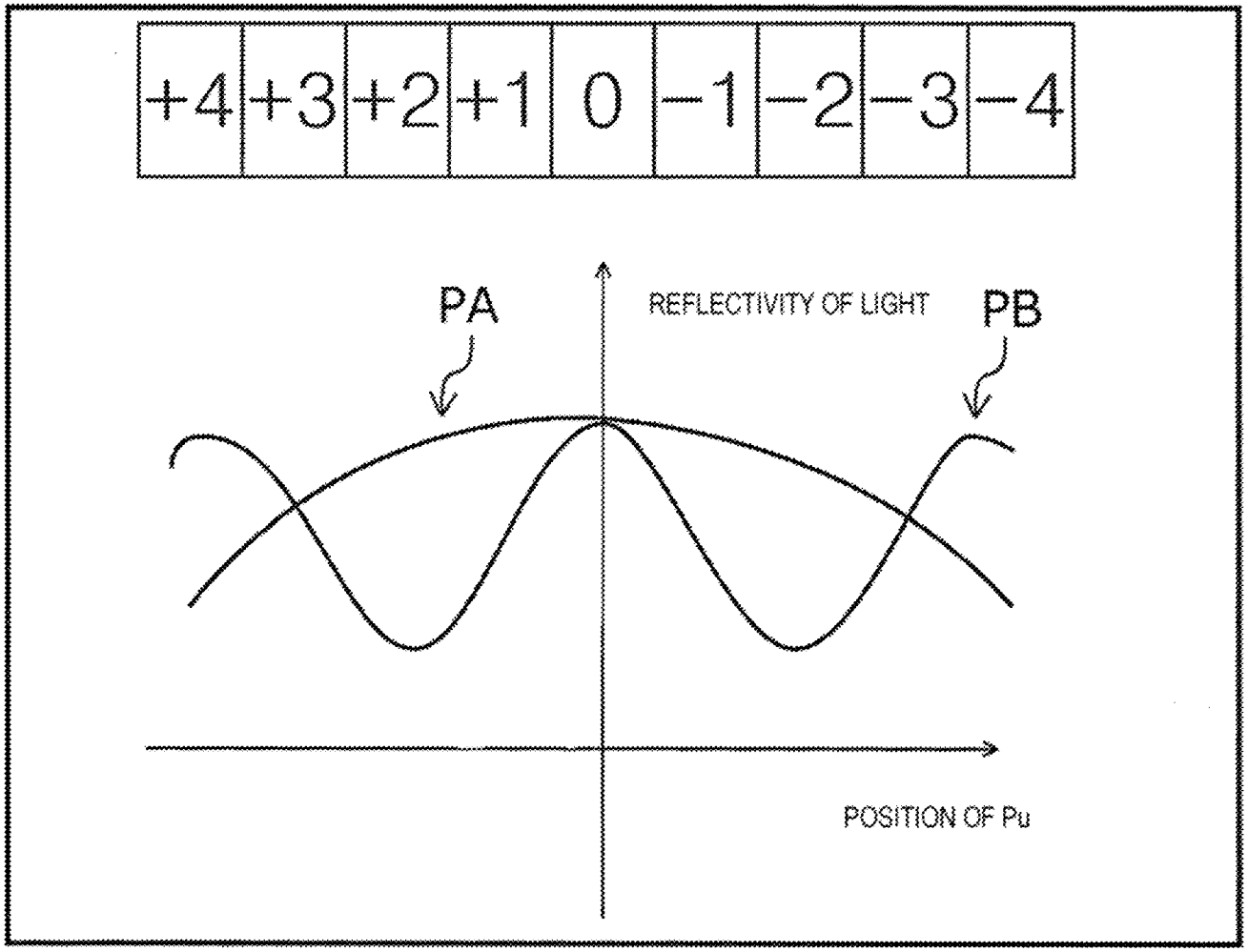
FIG. 8 is a schematic view illustrating a cycle of the rough adjustment pattern and the fine adjustment pattern.

Here, in the graph of FIG. 5, the unit Pu having the rectangular patterns, which corresponds to the numeral 0, is the unit Pu having the rectangular patterns with the lowest image density. Meanwhile, in the graph of FIG. 6, the three units including the unit Pu having the rectangular patterns, which corresponds to the numeral −4, the unit Pu having the rectangular patterns, which corresponds to the numeral 0, and the unit Pu having the rectangular patterns, which corresponds to the numeral +4, are the units Pu having the rectangular patterns with the lowest image density. In view of this, in the recording device 1 according to the present exemplary embodiment, the rough adjustment pattern PA and the fine adjustment pattern PB are associatedly positioned in the conveyance direction α. Specifically, this association is shown in FIG. 8 obtained by overlapping the graph of FIG. 5 and the graph of FIG. 6 with each other. As shown in the graph of FIG. 8, among the three units Pu having the rectangular patterns with the lowest image density in the fine adjustment pattern PB, the unit Pu having the rectangular patterns, which corresponds to the numeral 0, in the fine adjustment pattern PB is at the position closest to the unit Pu having the rectangular patterns with the lowest image density in the rough adjustment pattern PA. Therefore, the control unit 11 sets a conveyance amount so that the set conveyance amount corresponds to the unit Pu having the rectangular patterns, which corresponds to the numeral 0, in the fine adjustment pattern PB.

For example, a rotation amount of the driving roller 7 from the time of forming the reference pattern Pa to the time of forming the shift pattern Pc overlapping with the reference pattern Pa is set to an amount by one inch. A conveyance amount corresponds to the units Pu having the rectangular patterns, which corresponds to the numeral 0, in the rough adjustment pattern PA and the fine adjustment pattern PB is set to one inch. Specifically, when the rough adjustment pattern PA and the fine adjustment pattern PB, which correspond to the numeral 0, are formed, the nozzles for forming the reference pattern Pa and the nozzles for forming the shift pattern Pc are the same nozzles.

Further, for the unit Pu corresponding to the numeral −1 in the rough adjustment pattern PA, the nozzles for forming the shift pattern Pc are shifted by two nozzles from the nozzles for forming the reference pattern Pa. Similarly, shift is made by four nozzles for the unit Pu corresponding to the numeral −2, by six nozzles for the unit Pu corresponding to the numeral −3, and by eight nozzles for the unit Pu corresponding to the numeral −4. In contrast, for the unit Pu corresponding to the numeral +1, the nozzles for forming the shift pattern Pc are shifted by two nozzles from the nozzles for forming the reference pattern Pa in a direction reverse to the direction in the case of forming the unit Pu corresponding to the numeral −1. Similarly, shift is made by four nozzles for the unit Pu corresponding to the numeral +2, by six nozzles for the unit Pu corresponding to the numeral +3, and by eight nozzles for the unit Pu corresponding to the numeral +4. When a nozzle interval in the conveyance direction α is a 1/300 inch, the plurality of units Pu shifted by a 1/150 (2/300) inch from the unit Pu for the numeral 0, which corresponds to a conveyance amount of one inch, are formed in the rough adjustment pattern PA. Specifically, when the rough adjustment pattern PA is formed, regarding the nozzles for forming the reference pattern Pa, the nozzles to be used are changed to the nozzles downstream in the conveyance direction α toward a going direction β1. In this manner, the shift pattern Pc is formed. Note that, in the rough adjustment pattern PA, the plurality of units Pu corresponding to the reference pattern Pa, which are formed to be arrayed in the direction β, are one examples of a plurality of first patterns. Further, in the rough adjustment pattern PA, the plurality of units Pu corresponding to the shift pattern Pc, which are formed to be arrayed in the direction β, are one examples of a plurality of third patterns.

Meanwhile, in the fine adjustment pattern PB, for the unit Pu corresponding to the numeral −1, the nozzles for forming the shift pattern Pc are shifted by one nozzle from the nozzles for forming the reference pattern Pa. Similarly, shift is made by two nozzles for the unit Pu corresponding to the numeral −2, by three nozzles for the unit Pu corresponding to the numeral −3, and by four nozzles for the unit Pu corresponding to the numeral −4. In contrast, for the unit Pu corresponding to the numeral +1, the nozzles for forming the shift pattern Pc are shifted by one nozzle from the nozzles for forming the reference pattern Pa in a direction reverse to the direction in the case of forming the unit Pu corresponding to the numeral −1. Similarly, shift is made by two nozzles for the unit Pu having the rectangular patterns, which correspond to the numeral +2, by three nozzles for the unit Pu corresponding to the numeral +3, and by four nozzles for the unit Pu corresponding to the numeral +4. When a nozzle interval in the conveyance direction α is a 1/300 inch, the plurality of units Pu having the rectangular patterns shifted by a 1/300 inch from the unit Pu having the rectangular patterns and corresponding to the numeral 0, which corresponds to a conveyance amount of one inch, are formed in the rough adjustment pattern PA. Specifically, when the fine adjustment pattern PB is formed, regarding the nozzles for forming the reference pattern Pa, the nozzles to be used are changed to the nozzles downstream in the conveyance direction α toward a going direction β1. In this manner, the shift pattern Pc is formed. Note that, in the fine adjustment pattern PB, the plurality of units Pu corresponding to the reference pattern Pa, which are formed to be arrayed in the direction β, are one examples of a plurality of second patterns. Further, in the fine adjustment pattern PB, the plurality of units Pu corresponding to the shift pattern Pc, which are formed to be arrayed in the direction β, are one examples of a plurality of fourth patterns.

Here, these can be summarized as follows. the recording device 1 according to the present exemplary embodiment includes the recording head 4 and the conveyance roller pair 5. The recording head 4 includes nozzle rows N for ejecting ink and is movable reciprocally in the direction β being the first direction intersecting the nozzle rows N. The conveyance roller pair 5 moves the target recording medium M and the recording head 4 relatively with each other in the conveyance direction α being the second direction intersecting the direction β. Further, the ink is ejected from the recording head 4, and the recording head 4 is moved. In this manner, the plurality of units Pu corresponding to the reference pattern Pa in the rough adjustment pattern PA, which are the plurality of first patterns, and the plurality of units Pu corresponding to the reference pattern Pa in the fine adjustment pattern PB, which are the plurality of second patterns, are formed on the target recording medium M in the direction β. Further, with shift by a first shift amount in the conveyance direction α, the plurality of units Pu corresponding to the shift pattern Pc in the rough adjustment pattern PA, which are the plurality of third patterns, are formed correspondingly to the plurality of first patterns. With shift by a second shift amount in the conveyance direction α, which is smaller than the first shift amount, the plurality of units Pu corresponding to the shift pattern Pc in the fine adjustment pattern PB, which are the plurality of fourth patterns, are formed correspondingly to the plurality of second patterns. The recording device 1 includes the control unit 11 for controlling such formation. Here, the rough adjustment pattern PA formed of the plurality of first patterns and the plurality of third patterns and the fine adjustment pattern PB formed of the plurality of second patterns and the plurality of fourth patterns are associatedly positioned in the conveyance direction α. Further, as apparent from FIG. 5 and FIG. 6, the rough adjustment pattern PA is a pattern in which the image density of the overlapping pattern Pd, which is a pattern pair of the first pattern and the corresponding third pattern, changes in the direction β in a first cycle. The fine adjustment pattern PB is a pattern in which the image density of the overlapping pattern Pd, which is a pattern pair of the second pattern and the corresponding fourth pattern, changes in the direction β in a second cycle shorter than the first cycle.

As described above, with the recording device 1 according to the present exemplary embodiment, a plurality of pattern pairs of the first patterns and the third patterns as the rough adjustment pattern PA and a plurality of pattern pairs of the second patterns and the four patterns as the fine adjustment pattern PB are formed in the direction β being the reciprocating direction of the recording head 4. Thus, with the recording device 1 according to the present exemplary embodiment, the rough adjustment pattern PA and the fine adjustment pattern PB can be formed simultaneously, and hence a time period required for adjusting a conveyance amount of the target recording medium M can be shortened effectively.

Note that, in general, when the rough adjustment pattern PA and the fine adjustment pattern PB are used to adjust a conveyance amount of a medium such as the target recording medium M, it is conceived that the rough adjustment pattern PA is formed to perform rough adjustment and the fine adjustment pattern PB is formed to perform fine adjustment. This is because the adjustment of the conveyance amount of the medium itself cannot be performed in some cases only by the adjustment with the fine adjustment pattern PB. That is, an adjustment range with the fine adjustment pattern PB at high accuracy is small, and thus the adjustment range may not cover all when rough adjustment is not performed before forming the fine adjustment pattern PB. Further, as a matter of course, adjustment accuracy is lowered when adjustment is performed only with the rough adjustment pattern PA.

In contrast, with the recording device 1 according to the present exemplary embodiment, the rough adjustment pattern PA and the fine adjustment pattern PB are associatedly positioned in the conveyance direction α. The fine adjustment pattern PB is a pattern in which the image density cyclically changes in the direction β, and also is a pattern having the cyclic change in the cycle shorter than the cycle of the rough adjustment pattern PA. Specifically, the rough adjustment pattern PA enables the adjustment of the conveyance amount of the medium in a wider adjustment range, and highly accurate adjustment can be performed with the fine adjustment pattern PB in the adjustment range associated with the rough adjustment pattern PA.

Here, as shown in the graph of FIG. 6 and the graph of FIG. 8, the fine adjustment pattern PB has the cyclic change for two cycles. The fine adjustment pattern PB preferably has the cyclical change for two or more cycles as described above. This is because the adjustment range with the fine adjustment pattern PB in the conveyance direction α, which is associated with the rough adjustment pattern PA, can be secured widely, and also because at least one of the adjustment range and the adjustment accuracy of a position of the ink landing on the target recording medium M can be improved.

Further, as described above, in the recording device 1 according to the present exemplary embodiment, when the reference pattern Pa is formed, the driven nozzles Non and the non-driven nozzles Noff for forming the units Pu can remain the same. When the shift pattern Pc is formed, the driven nozzles Non and the non-driven nozzles Noff for forming the units Pu can be shifted by one or a plurality of nozzles in the direction β every time a subsequent unit Pu is formed. In another expression, by changing the used nozzles among the plurality of nozzles included in the nozzle row N, the control unit 11 is capable of performing control so that the plurality of shift patterns Pc are formed correspondingly to the plurality of reference patterns Pa while changing the shift amount in the conveyance direction α. Specifically, the control unit 11 is capable of performing control so as to form the plurality of third patterns correspondingly to the plurality of first patterns while changing the shift amount by the first shift amount in the conveyance direction α and to form the plurality of fourth patterns correspondingly to the plurality of second patterns while changing the shift amount by the second shift amount, which is smaller than the first shift amount, in the conveyance direction α.

In this manner, the rough adjustment pattern PA and the fine adjustment pattern PB are formed by changing the used nozzles, and thus there is no need to repeatedly form the adjustment pattern P for the conveyance amount a plurality of times while changing the conveyance amount. Specifically, the adjustment pattern P is formed by changing the used nozzles as described above, the adjustment pattern P for the convenience amount can be formed easily in a shorter time period. Moreover, the conveyance amount can be adjusted easily in a shorter time period. Specifically, for example, assuming that only the adjustment pattern P corresponding to row A is formed, a plurality of pattern pairs of the first patterns and the third patterns and a plurality of pattern pairs of the second patterns and the fourth patterns are formed by changing the used nozzles. Among those pattern pairs, preferable pattern pairs, for example, the overlapping patterns Pd corresponding to the numeral 0, are selected. Based on the used nozzles for forming the preferable pattern pairs, a preferable adjustment amount is calculated. In this manner, the conveyance amount can be adjusted easily in a shorter time period. Further, by changing the used nozzles among the plurality of nozzles included in the nozzle row N, the first shift amount and the second shift amount can be set to an integer time of the pitch between the plurality of nozzles. The value of the pitch between the plurality of nozzles is determined in advance at predetermined accuracy at the time of manufacturing of the recording head 4. Therefore, by using the pitch between the plurality of nozzles, namely, the nozzle interval, the value of the first shift amount and the value of the second shift amount are determined at predetermined accuracy. The rough adjustment pattern PA and the fine adjustment pattern PB with accuracy falling within the predetermined range are formed, and thus degradation of accuracy of the adjustment of the conveyance amount can be suppressed.

Further, in the recording device 1 according to the present exemplary embodiment, the rough adjustment pattern PA and the fine adjustment pattern PB are associated with each other so that the selected range of the fine adjustment pattern PB is selected along with selection of the selected position in the rough adjustment pattern PA. Specifically, by selecting a numeral among the numerals from −4 to +4 of for the rough adjustment pattern PA, the selected range of the fine adjustment pattern PB from the numerals −4 to +4 is limited. Specifically, in the recording device 1 according to the present exemplary embodiment, the rough adjustment pattern PA and the fine adjustment pattern PB are associated with each other in the conveyance direction α so that the selected range of the fine adjustment pattern PB is selected along with selection of the selected position in the rough adjustment pattern PA. For example, when the numeral 0 is selected for the rough adjustment pattern PA, selection is only made within the range of from the numerals −1 to +1 for the fine adjustment pattern PB. Further, the control unit 11 sets an adjustment value for the conveyance amount of the target recording medium M, based on a reference value selected from the selected range of the fine adjustment pattern PB. The recording device 1 according to the present exemplary embodiment has such a configuration, and thus the selected range of the reference value of the fine adjustment pattern PB can be selected easily by selecting the selected position in the rough adjustment pattern PA. In this case, for example, the sensor 16 reads the image density of the rough adjustment pattern PA and the fine adjustment pattern PB simultaneously, and the control unit 11 selects the selected range of the fine adjustment pattern PB along with selection of the selected position in the rough adjustment pattern PA. Specifically, the control unit 11 selects the overlapping pattern Pd with the lowest image density among the plurality of overlapping patterns Pd corresponding to the rough adjustment pattern PA. Further, an optimum value is further searched for among the overlapping pattern Pd with the lowest image density and the plurality of overlapping patterns Pd corresponding to the fine adjustment pattern PB associated in the conveyance direction α. Specifically, after the image density of the rough adjustment pattern PA and the image density of the fine adjustment pattern PB are read simultaneously, the control unit 11 determines the rough range for the adjustment value, based on the rough adjustment pattern PA, and then determines an optimum adjustment value, based on the image density of the fine adjustment pattern PB. With this, a time period required for adjusting the conveyance amount can be shortened. Note that, the adjustment value is not limited to the numerals from −4 to +4, and may be a magnitude of the conveyance amount itself.

Next, a conveyance amount adjustment procedure in the recording device 1 according to the present exemplary embodiment will be described in detail, with reference to FIG. 4. In FIG. 4, the target recording medium M is not moved in the conveyance direction α, but the recording head 4 is moved. Specifically, the moving direction of the recording head 4 as seen from the target recording medium M is reverse to the conveyance direction α.

First, the first rough adjustment patterns PA1 and the first fine adjustment patterns PB1 are formed. Specifically, first, the recording head 4 is moved in the going direction β1 of the direction β. During that time, the reference pattern Pa of each of the rough adjustment pattern PA and the fine adjustment pattern PB corresponding to row A is formed through use of the region Na of the nozzle row N. Next, the target recording medium M is conveyed by a predetermined conveyance amount, and the recording head 4 is moved in a returning direction β2 of the direction β. During that time, the reference pattern Pa of each of the rough adjustment pattern PA and the fine adjustment pattern PB corresponding to row B is formed through use of the region Na of the nozzle row N.

Next, the target recording medium M is conveyed by a predetermined conveyance amount, and the recording head 4 is moved in the going direction β1. During that time, the reference pattern Pa of each of the rough adjustment pattern PA and the fine adjustment pattern PB corresponding to row C is formed through use of the region Na of the nozzle row N, and the shift pattern Pc of each of the rough adjustment pattern PA and the fine adjustment pattern PB corresponding to row A is formed through use of the region Nc of the nozzle row N. Here, formation of the overlapping patterns Pd of the rough adjustment pattern PA and the fine adjustment pattern PB corresponding to row A is completed.

Next, the target recording medium M is conveyed by a predetermined conveyance amount, and the recording head 4 is moved in the returning direction β2. During that time, the reference pattern Pa of each of the rough adjustment pattern PA and the fine adjustment pattern PB corresponding to row D is formed of through use of the region Na of the nozzle row N, and the shift pattern Pc of each of the rough adjustment pattern PA and the fine adjustment pattern PB corresponding to row B is formed of through use of the region Nc of the nozzle row N. Here, formation of the overlapping patterns Pd of the rough adjustment pattern PA and the fine adjustment pattern PB corresponding to row B is completed.

Next, the target recording medium M is conveyed by a predetermined conveyance amount, and the recording head 4 is moved in the going direction β1. During that time, the shift pattern Pc of each of the rough adjustment pattern PA and the fine adjustment pattern PB corresponding to row C is formed of through use of the region Nc of the nozzle row N. Here, formation of the overlapping patterns Pd of the rough adjustment pattern PA and the fine adjustment pattern PB corresponding to row C is completed.

Next, the target recording medium M is conveyed by a predetermined conveyance amount, and the recording head 4 is moved in the returning direction β2. During that time, the shift pattern Pc of each of the rough adjustment pattern PA and the fine adjustment pattern PB corresponding to row D is formed of through use of the region Nc of the nozzle row N. Here, formation of the overlapping patterns Pd of the rough adjustment pattern PA and the fine adjustment pattern PB corresponding to row D is completed. Further, along with the completion of formation of the overlapping patterns Pd of the rough adjustment pattern PA and the fine adjustment pattern PB corresponding to row D, formation of the first rough adjustment patterns PA1 and the first fine adjustment patterns PB1 is completed.

Next, the second rough adjustment patterns PA2 and the second fine adjustment patterns PB2 are formed. Specifically, first, the driving roller 7 is rotated to a position deviated by a half rotation from a rotation starting position at which formation of the first rough adjustment patterns PA1 and the first fine adjustment patterns PB1 are started, and conveyance is performed by the conveyance amount L0. Specifically, conveyance is performed by the conveyance amount L0 larger than a predetermined conveyance amount for forming the rough adjustment pattern PA and the fine adjustment pattern PB in each of row A to row D. Further, the recording head 4 is moved in the going direction β1. During that time, the reference pattern Pa of each of the rough adjustment pattern PA and the fine adjustment pattern PB corresponding to row E is formed of through use of the region Na of the nozzle row N. Next, the target recording medium M is conveyed by a predetermined conveyance amount, and the recording head 4 is moved in the returning direction β2. During that time, the reference pattern Pa of each of the rough adjustment pattern PA and the fine adjustment pattern PB corresponding to row F is formed of through use of the region Na of the nozzle row N.

Next, the target recording medium M is conveyed by a predetermined conveyance amount, and the recording head 4 is moved in the going direction β1. During that time, the reference pattern Pa of each of the rough adjustment pattern PA and the fine adjustment pattern PB corresponding to row G is formed through use of the region Na of the nozzle row N, and the shift pattern Pc of each of the rough adjustment pattern PA and the fine adjustment pattern PB corresponding to row E is formed through use of the region Nc of the nozzle row N. Here, formation of the overlapping patterns Pd of the rough adjustment pattern PA and the fine adjustment pattern PB corresponding to row E is completed.

Next, the target recording medium M is conveyed by a predetermined conveyance amount, and the recording head 4 is moved in the returning direction β2. During that time, the reference pattern Pa of each of the rough adjustment pattern PA and the fine adjustment pattern PB corresponding to row H is formed through use of the region Na of the nozzle row N, and the shift pattern Pc of each of the rough adjustment pattern PA and the fine adjustment pattern PB corresponding to row F is formed through use of the region Nc of the nozzle row N. Here, formation of the overlapping patterns Pd of the rough adjustment pattern PA and the fine adjustment pattern PB corresponding to row F is completed.

Next, the target recording medium M is conveyed by a predetermined conveyance amount, and the recording head 4 is moved in the going direction β1. During that time, the shift pattern Pc of each of the rough adjustment pattern PA and the fine adjustment pattern PB corresponding to row G is formed of through use of the region Nc of the nozzle row N. Here, formation of the overlapping patterns Pd of the rough adjustment pattern PA and the fine adjustment pattern PB corresponding to row G is completed.

Next, the target recording medium M is conveyed by a predetermined conveyance amount, and the recording head 4 is moved in the returning direction β2. During that time, the shift pattern Pc of each of the rough adjustment pattern PA and the fine adjustment pattern PB corresponding to row H is formed of through use of the region Nc of the nozzle row N. Here, formation of the overlapping patterns Pd of the rough adjustment pattern PA and the fine adjustment pattern PB corresponding to row H is completed. Further, along with the completion of formation of the overlapping patterns Pd of the rough adjustment pattern PA and the fine adjustment pattern PB corresponding to row H, formation of the second rough adjustment patterns PA2 and the second fine adjustment patterns PB2 is completed.

Note that, as described above, the conveyance roller pair 5 in the present exemplary embodiment includes the driving roller 7 for moving the target recording medium M in the conveyance direction α, and has a configuration capable of conveying the target recording medium M easily with the driving roller 7.

Figure 9:
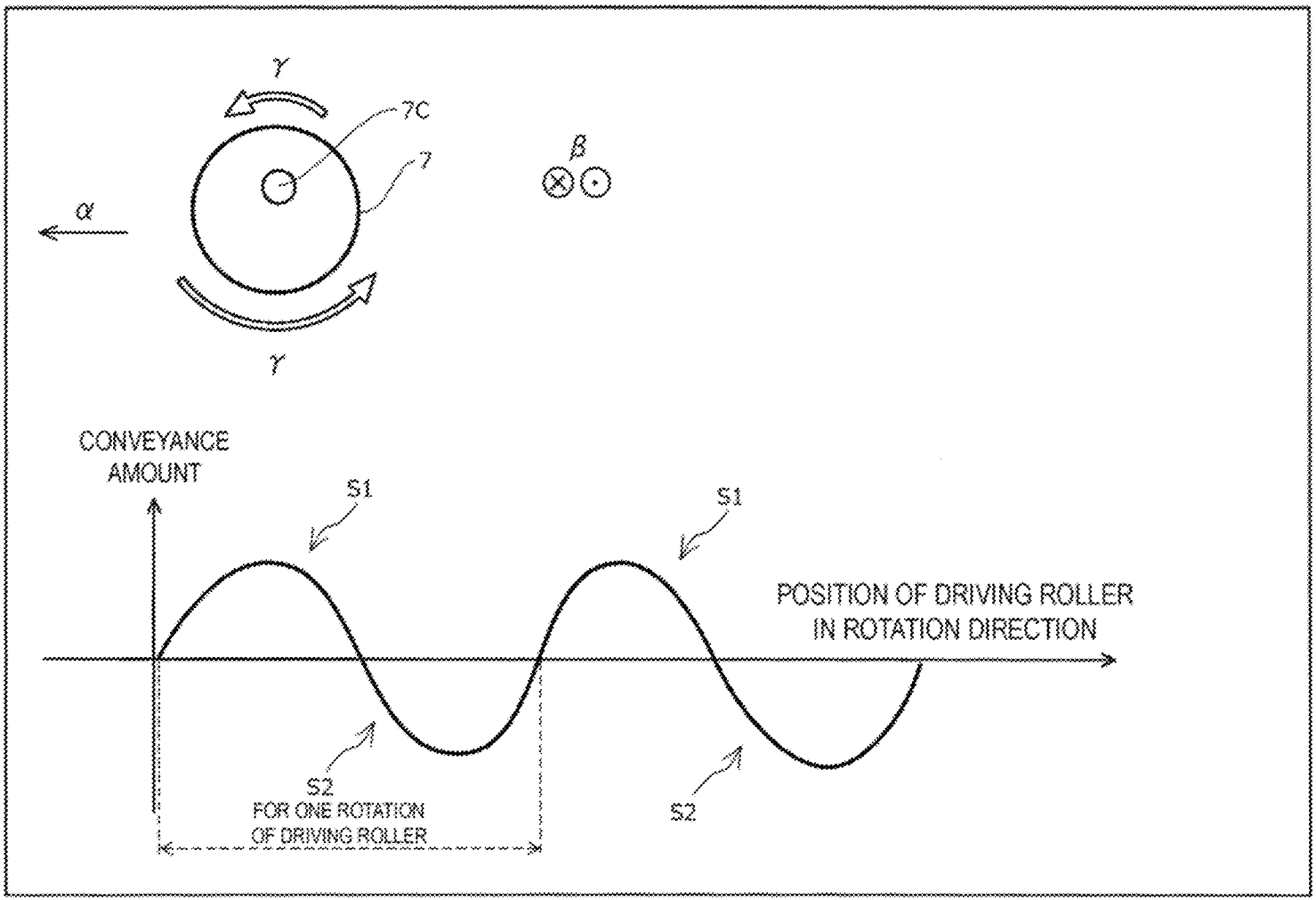
FIG. 9 is a schematic view illustrating a relationship between a rotation amount of a driving roller and a conveyance amount of a medium, correspondingly to arrangement of the driving roller of the recording device according to the exemplary embodiment of the present disclosure.

Here, the reason for forming the second rough adjustment patterns PA2 and the second fine adjustment patterns PB2 in addition to the first rough adjustment patterns PA1 and the first fine adjustment patterns PB1 will be described with reference to FIG. 9. FIG. 9 illustrates the driving roller 7, and gives a graph showing a conveyance amount corresponding to a position of the driving roller 7 in the rotation direction γ.

The driving roller 7 illustrated in FIG. 9 includes a rotary shaft 7C extending in the direction β. The position of the rotary shaft 7C is eccentric by being deviated from the center position of the driving roller 7. As in this case, the driving roller 7 may be eccentric. Further, with the eccentric driving roller 7 is eccentric, as shown in the graph of FIG. 9, the conveyance amount cyclically changes when the driving roller 7 is rotated in the rotation direction γ.

As shown in the graph of FIG. 9, the cycle of the conveyance amount corresponds to one rotation of the driving roller 7. Thus, a difference may be generated in the conveyance amount even when a rotation angle of the driving roller 7 is the same when comparison is made between a case where the driving roller 7 is rotated only in a region S1 with a more conveyance amount during formation of the adjustment pattern P and a case where the driving roller 7 is rotated only in a region S2 with a less conveyance amount during formation of the adjustment pattern P.

Here, the cycle of the conveyance amount corresponds to one rotation of the driving roller 7. Thus, the adjustment pattern P is formed by rotating the driving roller 7 in a state of being deviated to a position by a distance corresponding to a half rotation of the driving roller 7, and then the adjustment amounts obtained by those adjustment patterns P are averaged. In this manner, influence from the difference in the conveyance amount can be reduced. Thus, the recording device 1 according to the present exemplary embodiment has the following configuration. That is, under control of the control unit 11, the second rough adjustment patterns PA2 and the second fine adjustment patterns PB2 can be formed in addition to the first rough adjustment patterns PA1 and the first fine adjustment patterns PB1, and the adjustment amount for the rough adjustment and the adjustment amount for the fine adjustment can be respectively determined based on the average value of the adjustment amounts obtained from the first rough adjustment patterns PA1 and the adjustment amounts obtained from the second rough adjustment patterns PA2 and the average value of the adjustment values obtained from the first fine adjustment patterns PB1 and the adjustment values obtained from the second fine adjustment patterns PB2.

In another expression, in the recording device 1 according to the present exemplary embodiment, the control unit 11 performs control to form the first rough adjustment patterns PA1 and the first fine adjustment patterns PB1 during the first pattern formation operation, then rotate the driving roller 7 to the position deviated by the conveyance amount L0, that is, a distance for a half rotation from the rotation starting position in the first pattern formation operation, and form the second rough adjustment patterns PA2 and the second fine adjustment patterns PB2 during the second pattern formation operation. Under such control, shift from the optimum conveyance amount can be suppressed by, for example, averaging the results from the first pattern formation operation and the results from the second pattern formation operation even when the driving roller 7 is eccentric.

Figure 10:
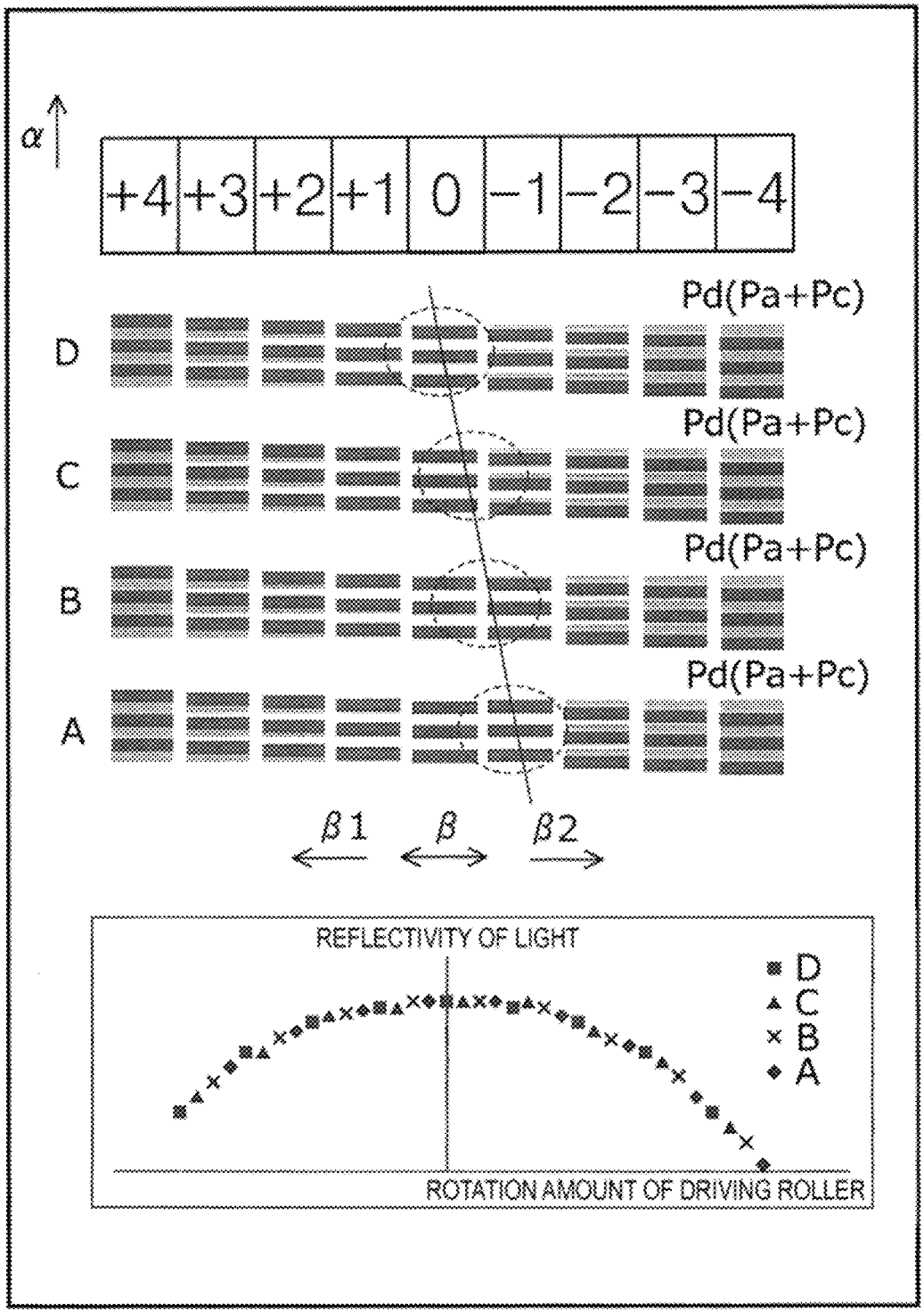
FIG. 10 is a schematic view illustrating a conveyance amount adjustment method using the adjustment patterns of the recording device according to the exemplary embodiment of the present disclosure.

Next, each of the first rough adjustment patterns PA1 and each of the first fine adjustment patterns PB1 are formed in each of the four rows from row A to row D and each of the second rough adjustment patterns PA2 and each of the second fine adjustment patterns PB2 are formed in each of the four rows from row E to row H. That is, the rough adjustment patterns PA and the fine adjustment pattern PB form a pattern for the plurality of rows. The reason for this will be described with reference to FIG. 10. FIG. 10 illustrates an example of the first rough adjustment patterns PA1, and the reason will be described based on the first rough adjustment patterns PA1. However, the second rough adjustment patterns PA2, the reason regarding to the first fine adjustment patterns PB1, and the second fine adjustment patterns PB2 is similar to the example of the first rough adjustment patterns PA1.

With the recording device 1 according to the present exemplary embodiment, under control of the control unit 11, a conveyance amount from the position for forming the reference pattern Pa to the position for forming the shift pattern Pc at the time of forming the overlapping pattern Pd in row A, a conveyance amount from the position for forming the reference pattern Pa to the position for forming the shift pattern Pc at the time of forming the overlapping pattern Pd in row B, a conveyance amount from the position for forming the reference pattern Pa to the position for forming the shift pattern Pc at the time of forming the overlapping pattern Pd in row C, and a conveyance amount from the position for forming the reference pattern Pa to the position for forming the shift pattern Pc at the time of forming the overlapping pattern Pd in row D are slightly changed from one another. Specifically, as illustrated in FIG. 4, a conveyance amount L1 from the position for forming the reference pattern Pa in row A with the region Na to the position for forming the reference pattern Pa in row B with the region Na and a conveyance amount L2 from the position for forming the reference pattern Pa in row B with the region Na to the position for forming the reference pattern Pa in row C with the region Na and the position for forming the shift pattern Pc in row A with the region Nc are changed from each other. Further, a conveyance amount L3 from the position for forming the reference pattern Pa in row C with the region Na and the position for forming the shift pattern Pc in row A with the region Nc to the position for forming the reference pattern Pa in row D with the region Na and the position for forming the shift pattern Pc in row B with the region Nc is changed. Further, a conveyance amount L4 from the position for forming the reference pattern Pa in row D with the region Na and the position for forming the shift pattern Pc in row B with the region Nc to the position for forming the shift pattern Pc in row C with the region Nc is changed. Further, the conveyance amount L5 from the position for forming the shift pattern Pc in row C with the region Nc to the position for forming the shift pattern Pc in row D with the region Nc is changed.

Here, the recording device 1 according to the present exemplary embodiment has a configuration in which the target recording medium M can be conveyed, that is, the driving roller 7 can be rotated by a conveyance amount shorter than the nozzle interval in the nozzle row N in the conveyance direction α. For example, when the nozzle interval is 1/300 inch, the target recording medium M can be conveyed by a conveyance amount of 1/1200 inch. Further, the sum of the conveyance amount L4 and the conveyance amount L5, which are the conveyance amounts for forming row D, is 1 inch. The sum of the conveyance amount L3 and the conveyance amount L4, which are the conveyance amounts for forming row C, is 1 inch+1/1200 inch. The sum of the conveyance amount L2 and the conveyance amount L3, which are the conveyance amounts for forming row B, is 1 inch+1/600 (2/1200) inch. The sum of the conveyance amount L1 and the conveyance amount L2, which are the conveyance amounts for forming row A, is 1 inch+1/400 (3/1200) inch. Thus, differences in the conveyance amounts for the rows from the positions for forming the reference patterns Pa to the positions for forming the shift pattern Pc are shorter than the nozzle interval.

In FIG. 10, in row A, the unit Pu corresponding to the numeral −1 is the unit Pu with the lowest image density. Further, in row B, the unit Pu having the rectangular patterns, which corresponds to the numeral −1, and the unit Pu corresponding to the numeral 0 are the units Pu with the lowest image density. Further, in row C, the unit Pu corresponding to the numeral 0 is the unit Pu with the lowest image density. Further, in row D, the unit Pu corresponding to the numeral 0 is the unit Pu with the lowest image density. Specifically, the units Pu, which are in the broken-line circles and are positioned on the straight line connecting the broken-line circles in FIG. 10, are the units Pu with the lowest image density. Here, the graph of FIG. 10 is obtained by graphing reflectivity of light corresponding to positions of the driving roller 7 in the rotation direction γ, that is, a rotation amount of the driving roller 7, in consideration of the conveyance amount L1 for forming the reference pattern Pa to the conveyance amount L5 for forming the shift pattern Pc from row A to row D. Through use of the graph of FIG. 10, the conveyance amount with the lowest image density is calculated. With this, the conveyance amount can be adjusted at higher accuracy than a case where a preferable conveyance amount is calculated simply by changing the used nozzles and forming the adjustment pattern P. Note that, in FIG. 10, in each row from row A to row D, the position of the unit Pu with the lowest image density among the plurality of units Pu in the direction β is distributed to be shifted in a substantially simple manner from the numeral −1 to the numeral 0 toward the conveyance direction α. Specifically, when the positions of the units Pu with the lowest image density among the plurality of units Pu in each row from row A to row D are connected, a substantially liner line is obtained. For example, when the linear line is largely collapsed, that is, the numeral is changed to −4 in row D while the numerals are changed from −1 to 0 in a simple manner toward the conveyance direction α from row A to row C, it can be determined that abnormality is caused in the conveyance amount L4 and the conveyance amount L5, which are the conveyance amounts for forming row D. Whether the substantially liner line is obtained can be judged by sight of a user or automatically by the sensor 16 and the control unit 11.

As described above, the control unit 11 is capable of perform control so that formation of the rough adjustment pattern PA and the fine adjustment pattern PB and rotation of the driving roller 7 are executed for a plurality of times while changing a rotation amount of the driving roller 7. Thus, with the recording device 1 according to the present exemplary embodiment, the conveyance amount of the target recording medium M can be adjusted at particularly high accuracy.

Figure 11:
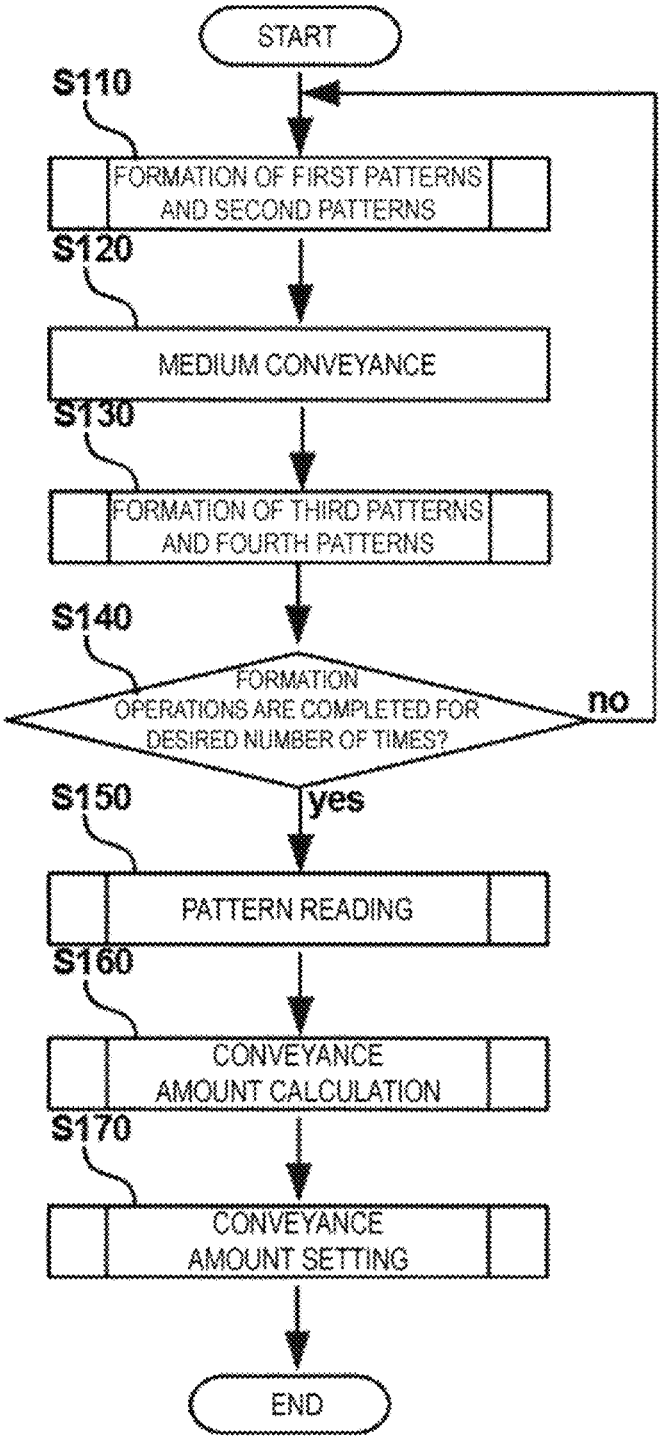
FIG. 11 is a flowchart illustrating the conveyance amount adjustment method according to the exemplary embodiment of the present disclosure.

Next, an exemplary embodiment of a conveyance amount adjustment method performed with the recording device 1 according to the present exemplary embodiment will be described with reference to the flowchart of FIG. 11.

When the conveyance amount adjustment method according to the present exemplary embodiment is started by an instruction of a user or the like, first, in Step S110, while ejecting the ink from the recording head 4 and moving the recording head 4 in the direction β, the plurality of reference patterns Pa of the rough adjustment pattern PA being the first patterns and the plurality of reference patterns Pa of the fine adjustment pattern PB being the second patterns are formed on the target recording medium M in the direction β. Step S110 corresponds to, for example, formation of the reference patterns Pa using the region Na in FIG. 2.

Further, after conveying the target recording medium M by a desired conveyance amount in Step S120, while ejecting the ink from the recording head 4 and moving the recording head 4 in the direction β, the plurality of shift patterns Pc of the rough adjustment pattern PA being the third patterns are formed, and the plurality of shift patterns Pc of the fine adjustment pattern PB being the fourth patterns are formed correspondingly to the first patterns and the third patterns respectively in Step S130. Step S130 corresponds to, for example, formation of the shift pattern Pc using the region Nc in FIG. 2.

Further, in Step S140, the control unit 11 determines whether formation operations of the adjustment patterns are performed for the desired number of times. Specifically, for example, when the adjustment pattern P illustrated in FIG. 2 is formed, it is determined whether the overlapping patterns Pd from row A to row H are formed. Further, when it is determined that the formation operations of the adjustment patterns are performed for the desired number of times, the processing proceeds to Step S150. In contrast, when it is not determined that the formation operations of the adjustment patterns are performed for the desired number of times, the processing returns to Step S110, and the formation operations of the adjustment patterns from Step S110 to Step S140 are repeated for the desired number of times.

Next, in Step S150, all the overlapping patterns Pd formed by repeating the formation operations of the adjustment patterns from Step S110 to Step S140 are read by the sensor 16.

Next, in Step S160, the control unit 11 calculates a predetermined conveyance amount, based on the reading result from the sensor 16. Note that, instead of executing Step S150 and Step S160, a user may select, through use of the PC 24 or the like, a desired overlapping pattern Pd with the lowest image density in which the reference pattern Pa and the shift pattern Pc overlap with each other most. When the user selects the desired overlapping pattern Pd, an evaluation result obtained by sight of the user may be used in place of the reading result from the sensor 16.

Further, in Step S170, the control unit 11 sets a conveyance amount, based on the calculation result in Step S160 or the selection result of the desired overlapping pattern Pd by the user, and thus the conveyance amount adjustment method according to the present exemplary embodiment is completed.

The matters described above will be given in another expression. The conveyance amount adjustment method according to the present exemplary embodiment is a conveyance amount adjustment method executed through use of the recording device 1 including the recording head 4 that includes nozzle rows N for ejecting the liquid and is movable reciprocally in the direction β and the conveyance roller pair 5 that moves the target recording medium M and the recording head 4 relatively with each other in the conveyance direction α intersecting the direction β. Further, the conveyance amount adjustment method includes Step S110 being a first step and Step S130 being a second step. In the first step, while ejecting the ink from the recording head 4 and moving the recording head 4, the reference patterns Pa of the rough adjustment pattern PA being the plurality of first patterns and the reference patterns Pa of the fine adjustment pattern PB being the plurality of second patterns are formed on the target recording medium M in the direction β. In the second step, while being shifted in the conveyance direction α by the first shift amount, the shift patterns Pc of the rough adjustment pattern PA being the plurality of third patterns are formed correspondingly to the plurality of first patterns, and while being shifted in the conveyance direction α by the second shift amount smaller than the first shift amount, the shift patterns Pc of the fine adjustment pattern PB being the plurality of fourth patterns are formed correspondingly to the plurality of second patterns. Here, as described above, the rough adjustment pattern PA formed of the plurality of first patterns and the plurality of third patterns and the fine adjustment pattern PB formed of the plurality of second patterns and the plurality of fourth patterns are associatedly positioned in the conveyance direction α. Further, as described above, the rough adjustment pattern PA is a pattern in which the image density of the overlapping pattern Pd, which is a pattern pair of the first pattern and the corresponding third pattern, changes in the direction β in a first cycle. The fine adjustment pattern PB is a pattern in which the image density of the overlapping pattern Pd, which is a pattern pair of the second pattern and the corresponding fourth pattern, changes in the direction β in a second cycle shorter than the first cycle.

As described above, in the first step and the second step in the conveyance amount adjustment method according to the present exemplary embodiment, a plurality of pattern pairs of the first patterns and the third patterns as the rough adjustment pattern PA and a plurality of pattern pairs of the second patterns and the four patterns as the fine adjustment pattern PB are formed in the direction β being the reciprocating direction of the recording head 4. Thus, the rough adjustment pattern PA and the fine adjustment pattern PB can be formed simultaneously, and hence a time period required for adjusting the conveyance amount of the target recording medium M can be shortened effectively.

Note that, the present disclosure is not limited to the exemplary embodiment described above, and the numeral values described above are merely examples. Moreover, many variations are possible within the scope of the disclosure as described in the claims. It goes without saying that such variations also fall within the scope of the disclosure.

What is claimed is:

1. A liquid ejecting device, comprising:

an ejecting unit that includes a nozzle row ejecting liquid and is configured to move reciprocally in a first direction intersecting the nozzle row;

a moving unit configured to move a medium and the ejecting unit relatively to each other in a second direction intersecting the first direction; and a control unit configured to perform control to cause the ejecting unit to eject the liquid, and cause the ejecting unit to move for forming a plurality of first patterns and a plurality of second patterns on the medium in the first direction, and forming a plurality of third patterns corresponding to the plurality of first patterns while changing a shifted amount by which the plurality of third patterns is shifted from the plurality of first patterns by a first shift amount in the second direction, and moreover forming a plurality of fourth patterns corresponding to the plurality of second patterns while changing a shifted amount by which the plurality of fourth patterns is shifted from the plurality of second patterns by a second shift amount smaller than the first shift amount, wherein a rough adjustment pattern and a fine adjustment pattern positionally associated with each other in the second direction, the rough adjustment pattern is formed of the plurality of first patterns and the plurality of third patterns, and the fine adjustment pattern is formed of the plurality of second patterns and the plurality of fourth patterns, the rough adjustment pattern is a pattern in which image density of a pair of patterns, which is formed of the plurality of first patterns and the plurality of third patterns corresponding to the plurality of first patterns, changes in the first direction in a first cycle, and the fine adjustment pattern is a pattern in which image density of a pair of patterns, which is formed of the plurality of second patterns and the plurality of fourth patterns corresponding to the plurality of second patterns, changes in the first direction in a second cycle shorter than the first cycle, the second cycle including two or more cycle changes for each first cycle of the rough adjustment pattern.

2. The liquid ejecting device according to claim 1, wherein the control unit performs, through changing at least one nozzle to be used among a plurality of nozzles included in the nozzle row, control to form the plurality of third patterns corresponding to the plurality of first patterns while changing a shifted amount by which the plurality of third patterns is shifted from the plurality of first patterns by a first shift amount in the second direction, and form the plurality of fourth patterns corresponding to the plurality of second patterns while changing a shifted amount by which the plurality of fourth patterns is shifted from the plurality of second patterns by a second shift amount smaller than the first shift amount.

3. The liquid ejecting device according to claim 1, wherein the moving unit includes a driving roller configured to move the medium in the second direction.

4. The liquid ejecting device according to claim 3, wherein the control unit performs control to, after forming the rough adjustment pattern and the fine adjustment pattern as a first pattern formation operation, rotate the driving roller by half a rotation from a rotation-starting position in the first pattern formation operation to form the rough adjustment pattern and the fine adjustment pattern as a second pattern formation operation.

5. The liquid ejecting device according to claim 3, wherein the control unit performs control to execute formation of the rough adjustment pattern and the fine adjustment pattern and rotation of the driving roller for a plurality of times, with a rotation amount of the driving roller being changed accordingly.

6. The liquid ejecting device according to claim 1, wherein the rough adjustment pattern and the fine adjustment pattern are associate with each other positionally in the second direction such that a selection range of the fine adjustment pattern is selected in conjunction with selection of a selection position in the rough adjustment pattern, and the control unit sets an adjustment value based on a reference value in the selection range.

7. A conveyance amount adjustment method executed using a liquid ejecting device including an ejecting unit that includes a nozzle row ejecting liquid and that is configured to move reciprocally in a first direction intersecting the nozzle row and a moving unit configured to move a medium and the ejecting unit relatively with each other in a second direction intersecting the first direction, the conveyance amount adjustment method comprising:

forming a plurality of first patterns and a plurality of second patterns on the medium in the first direction; and forming a plurality of third patterns corresponding to the plurality of first patterns while changing a shifted amount by which the plurality of third patterns is shifted from the plurality of first patterns by a first shift amount in the second direction, and forming a plurality of fourth patterns corresponding to the plurality of second patterns while changing a shifted amount by which the plurality of fourth patterns is shifted from the plurality of second patterns by a second shift amount smaller than the first shift amount in the second direction, wherein a rough adjustment pattern and a fine adjustment pattern positionally associated with each other in the second direction, the rough adjustment pattern is formed of the plurality of first patterns and the plurality of third patterns, and the fine adjustment pattern is formed of the plurality of second patterns and the plurality of fourth patterns, the rough adjustment pattern is a pattern in which image density of a pair of patterns, which is formed of the plurality of first patterns and the plurality of third patterns corresponding to the plurality of first patterns, changes in the first direction in a first cycle, and the fine adjustment pattern is a pattern in which image density of a pair of patterns, which is formed of the plurality of second patterns and the plurality of fourth patterns corresponding the plurality of second patterns, changes in the first direction in a second cycle shorter than the first cycle, the second cycle including two or more cycle changes for each first cycle of the rough adjustment pattern.

* * * * *